US007386907B2

(12) United States Patent
Otsuka et al.

(10) Patent No.: US 7,386,907 B2
(45) Date of Patent: Jun. 17, 2008

(54) CLEANING SHEET

(75) Inventors: Hiroshi Otsuka, Tochigi (JP); Hiroyuki Yanagida, Tochigi (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/540,879

(22) PCT Filed: Oct. 27, 2003

(86) PCT No.: PCT/JP03/13728

§ 371 (c)(1),
(2), (4) Date: Jan. 23, 2006

(87) PCT Pub. No.: WO2004/060133

PCT Pub. Date: Jul. 22, 2004

(65) Prior Publication Data

US 2006/0137119 A1 Jun. 29, 2006

(30) Foreign Application Priority Data

Dec. 27, 2002 (JP) ..... 2002-382125
Dec. 27, 2002 (JP) ..... 2002-382127

(51) Int. Cl.
*A47L 25/00* (2006.01)

(52) U.S. Cl. ..... 15/104.002; 15/209.1; 15/224; 15/228

(58) Field of Classification Search ..... None
See application file for complete search history.

(56) References Cited

U.S. PATENT DOCUMENTS 6,245,413 B1 * 6/2001 Kenmochi et al. ..... 428/157
6,550,092 B1 * 4/2003 Brown et al. ..... 15/104.002

FOREIGN PATENT DOCUMENTS

| | | |
|---|---|---|
| JP | 5-305049 | 11/1993 |
| JP | 3019136 | 9/1995 |
| JP | 9-10147 | 1/1997 |
| JP | 9-164110 | 6/1997 |
| JP | 9-220191 | 8/1997 |
| JP | 9-224895 | 9/1997 |
| JP | 9-224901 | 9/1997 |
| JP | 10-5163 | 1/1998 |
| JP | 10-323311 | 12/1998 |
| JP | 11-128156 | 5/1999 |
| JP | 11-313792 | 11/1999 |
| JP | 2000-93373 | 4/2000 |
| JP | 2002-119451 | 4/2002 |
| JP | 2002-165740 | 6/2002 |

* cited by examiner

*Primary Examiner*—David A Redding
(74) *Attorney, Agent, or Firm*—Oblon, Spivak, McClelland, Maier & Neustadt, P.C.

(57) ABSTRACT

A cleaning sheet adapted to be attached to the head (20) of a cleaning tool (2) and having a wiping portion (1A) adapted to be disposed on the lower side of the head (20). In the state attached to the head (20), the cleaning sheet has, in the wiping portion (1A) thereof, a plurality of tacky recesses (10) open to the front and the rear of the head (20). The cleaning sheet has pointed parts (10*b*) projecting to the front and the rear between borders (10*a*) of adjacent two of the recesses (10).

17 Claims, 17 Drawing Sheets

CLEANING SHEET

TECHNICAL FIELD

The present invention relates to a disposable cleaning sheet that is primarily adapted to be attached to the head of a cleaning tool and to be used to collect and trap dust and debris, such as house dust.

BACKGROUND ART

A variety of cleaning implements have been proposed for cleaning the surface of furniture, walls, and floors of houses, automotive interior trim, and the like. Amongst them is a cleaning tool having a handle and a head to which a cleaning sheet made of nonwoven fabric, etc. is attached.

The conventionally employed cleaning sheets are capable of entrapping hair, lint, soil or like dust and debris by entanglement in the fibers of nonwoven fabric but have difficulties in holding by entanglement all the dust and debris, from fine dust to solid particles of about 1 mm or greater in size, such as sand, pebbles, food crumbs, rice grains, and sesame seeds. Such large solid particles cannot be removed but with a dustpan or a vacuum cleaner.

Hence, a cleaning sheet or cloth having tacky parts disposed in the wiping portion thereof has been proposed in JP-A-9-164110 and JP-A-9-224895, which is capable of catching those dust particles that cannot be entangled in fibers by its tacky parts.

When the proposed cleaning sheet is used in a usual manner of cleaning, that is, when the cleaning sheet is slid on a surface to be cleaned, the dust and debris are not trapped onto the tacky parts. Therefore, a user must aim at the debris and press the cleaning sheet onto the debris with a certain force so that the debris may be trapped by the sticky parts. Even when a user presses a cleaning tool to catch debris, however, the dust trapping efficiency is low because the tacky parts are disposed in parts. Moreover, if large ones of various kinds of dust that have not been entangled in the fibers, i.e., large diameter dust particles or thick dust particles, are the first to be trapped by the tacky parts, the wiping part of the cleaning sheet is hindered by the large dust particles from coming into intimate contact with the surface to be cleaned. It can follow that the cleaning sheet fails to catch up not only the other kinds of dust that have not been entangled but also the dust that should otherwise be entangled in the fibers.

JP-A-2000-93373 proposes a cleaning sheet having a plurality of recesses along the edges (borders) between the wiping portion and the fixing portions so that relatively large dust particles may be led to the central region of the wiping portion through the recesses.

However, the borders contain straight linear parts along the length direction of a cleaning mop between every adjacent recesses. When the cleaning sheet is used in an ordinary sweeping operation (for example, sliding the wiping portion on a floor, etc.), the straight linear parts block the approach of dust. As a result, the cleaning sheet is incapable of catching dust sufficiently.

Merely having the recesses, the cleaning sheet has low capability of catching and holding the above-mentioned relatively large solid dust and is therefore incapable of trapping such dust sufficiently.

JP-A-10-5163 discloses a disposable wiping material which is substantially rectangle in its plan view, is made of fiber aggregates different in fiber density, and has a first surface and a second surface parallel to each other. The first surface is substantially flat. The cleaning sheet consists of side portions with a certain width and a high fiber density, each of which is along each of opposing parallel edges of the material, and a middle portion with a low fiber density between the side portions. The second surface is relatively low in the side portions and relatively high in the middle portion.

While the wiping material can keep the side portions a little distance away from the floor, etc., dust particles having a different size (height) from that distance are not brought into contact with the side portions, and the wiping material shows no collecting and trapping performance for the dust particles. When the wiping material is used in a usual sweeping operation (for example, sliding the wiping portion on a floor, etc.), it has difficulty in catching relatively large solid dust particles of the above stated size.

An object of the present invention is to provide a cleaning sheet with which relatively large solid dust particles as well as fine dust particles can be trapped without fail in a usual sweeping operation on an object to be cleaned.

DISCLOSURE OF THE INVENTION

The present invention accomplishes the above object by providing a cleaning sheet adapted to be attached to the head of a cleaning tool and having a wiping portion adapted to be disposed on the lower side of the head. The wiping portion, in the state attached to the head, has a plurality of tacky recesses open to at least one direction selected from the directions to the front, the rear, the left, and the right of the head. The wiping portion has a pointed or curved shape projecting in the at least one direction between borders of adjacent two of the recesses, the borders extending along the at least one direction.

The present invention accomplishes the above object by further providing a cleaning sheet adapted to be attached to the head of a cleaning tool and having a wiping portion adapted to be disposed on the lower side of the head. The wiping portion, in the state attached to the head, has a tacky recess extending in the length direction of the head with a prescribed width.

The present invention accomplishes the above object by furthermore providing a cleaning sheet adapted to be attached to the head of a cleaning tool and having a wiping portion adapted to be disposed on the lower side of the head. The wiping portion, in the state attached to the head, has a flat part and a tacky sloped or curved part rising from the flat part. The flat part and the sloped or curved part are disposed substantially along the lower side of the head.

BEST MODE FOR CARRYING OUT THE INVENTION

The present invention will be described based on its preferred embodiments with reference to the accompanying drawings.

Figure 1:
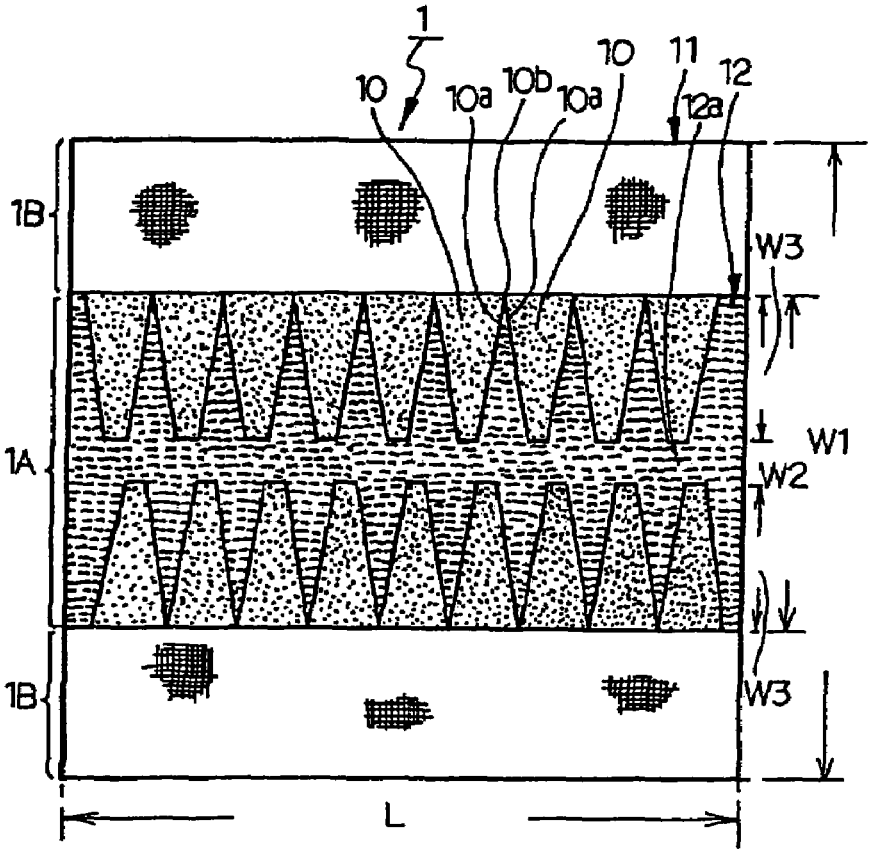
FIG. 1 is a plan schematically illustrating a first embodiment of the cleaning sheet according to the present invention.
Figure 2:
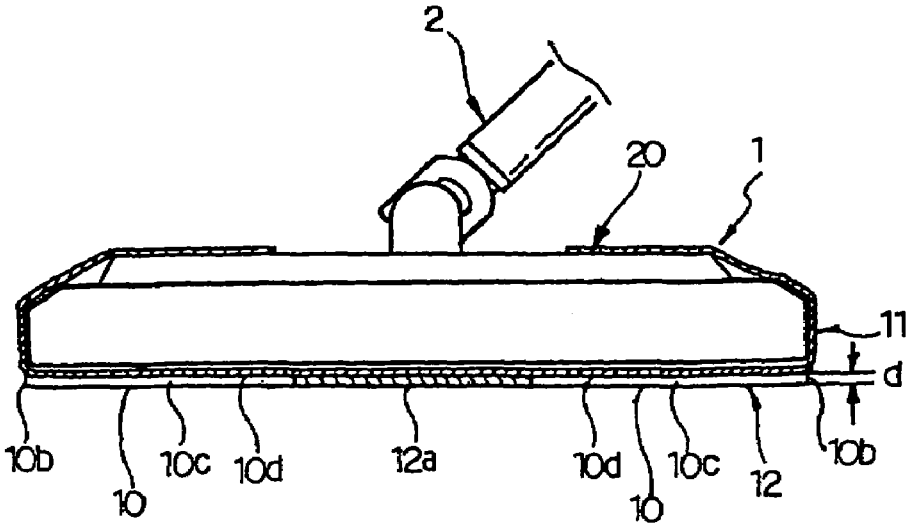
FIG. 2 is a schematic transverse cross section of the cleaning sheet of the first embodiment in the state attached to the head of a cleaning tool.
Figure 3:
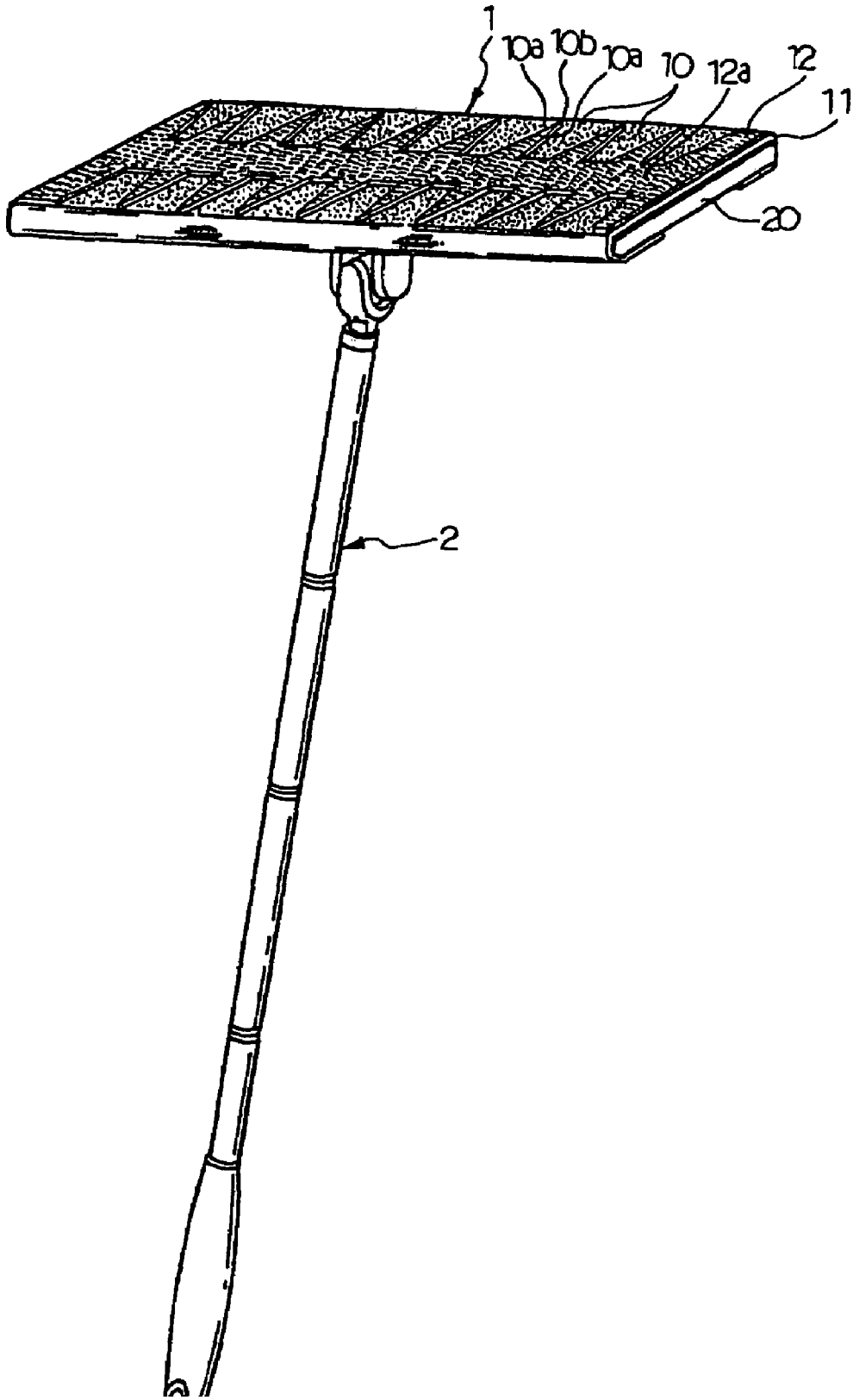
FIG. 3 is a schematic perspective of the cleaning sheet of the first embodiment in the state attached to the head of a cleaning sheet.

FIGS. 1 to 3 illustrate the first embodiment of the cleaning sheet according to the present invention. FIGS. 2 and 3 show the state of the cleaning sheet being attached to the head of a cleaning tool. In these figures, numerals 1 and 2 indicate the cleaning sheet and the cleaning tool, respectively.

As shown in FIG. 1, the cleaning sheet 1 has a rectangular shape in its plan view. The cleaning sheet 1 has a wiping portion 1A and fixing portions 1B located on both sides of the wiping portion 1A. In the state attached to the head 20 of the cleaning tool 2 as illustrated in FIGS. 2 and 3, the wiping portion 1A is disposed on the lower side of the head 20, and the fixing portions 1B are fixed to the upper side of the head 20.

While the cleaning sheet 1 is not particularly limited in size and shape, it is preferred that both length L and width W2 fall within ±30% of the length and the width, respectively, of the lower side of the head 20 of the cleaning tool 2. As the area of the head 20 of the cleaning tool 2 increases, the wiping portion 1A of the cleaning sheet 1 should have an accordingly increased area.

For general domestic applications, the length L is preferably 170 to 340 mm, and the width W2 of the wiping portion 1A is preferably 70 to 130 mm. The area of the wiping portion 1A is preferably 120 to 440 $cm^2$.

As illustrated in FIGS. 2 and 3, the wiping portion 1A, in its state attached to the head 20, has rows of adhesive recesses 10 that are open to the front and the rear of the head 20. As depicted in FIGS. 1 and 3, the individual recesses 10 have a trapezoidal shape in the plan. The front side recesses 10 and the rear side recesses 10 are not interconnected to each other.

For typical domestic applications of the cleaning sheet 1, the individual recesses 10 preferably have an area of 0.1 to 120 $cm^2$, more preferably 1 to 10 $cm^2$. The recesses with too small an area would soon be filled with relatively large solid dust particles. Too large an area of the individual recesses results in too low dust collecting performance of the other part of the wiping portion 1A. For example, when, as in the case of the first embodiment, a part corresponding to the wiping sheet 12 (described later) is expected to entangle or adsorb hair, lint, soil or like dust in or to the fibers, the amount of the dust captured by that part would be reduced.

The total area of the recesses 10 is preferably up to 70%, more preferably 50% or less, even more preferably 30% or less, of the area of the wiping portion 1A. The lower limit is preferably 5% taking into consideration the balance between the performance of trapping relatively large solid dust particles by the recesses 10 and the dust trapping performance of the other part of the wiping portion 1A.

The recesses 10 preferably have a depth d (see FIG. 2), which corresponds to the thickness of the wiping sheet 12 (described later) in the first embodiment, of 0.5 to 10 mm, more preferably 1 to 7 mm, even more preferably 2 to 5 mm, taking into consideration the size of relatively large solid dust particles expected to be captured. The length W3 of the recesses 10 in the width direction of the wiping portion 1A (i.e., the length from the edge of the head 20) is preferably from 5 to (0.8×W1) mm, more preferably 10 to (0.5×W1) mm, so that relatively large solid dust particles trapped may not stick out of the head edge and also taking dust collecting capacity into account. When W1 is 100 mm, W3 is 80 mm at the longest.

The cleaning sheet 1 has pointed shapes 10*b* projecting to the front and the rear of the head 20 between adjacent recesses 10, specifically between adjacent borders 10*a* extending toward the front or the rear. In other words, there is no edge that extends in the length direction of the head 20 between the adjacent borders 10*a*, which extend to the front or the rear, of the adjacent recesses 10.

The cleaning sheet 1 exhibits tack on the inner wall 10*c* (edge faces of the wiping sheet 12) and the flat bottom 10*d* of the individual recesses 10. The bottom 10*d* of each recess 10 does not have to be flat and may have an uneven surface or a cut. The inner walls 10*c* and the bottoms 10*d* may have a pressure-sensitive adhesive applied thereto in various patterns including a dot pattern.

The tack of the recesses 10 is preferably 1 to 30, more preferably 3 to 28, even more preferably 5 to 25, as expressed in terms of ball number (i.e., the nominal diameter of a ball multiplied by 32) in the rolling ball tack test specified in JIS Z0237 14 (test methods of pressure-sensitive adhesive tapes and sheets). Recesses with too low tack fail to trap the dust that has not been trapped by the cleaning portion. If a recess having too high tack is brought into contact with the surface to be cleaned, it is difficult to separate from the surface, which impairs the operationality.

Pressure-sensitive adhesives which impart tack to the recesses 10 include those of natural rubber type, styrene-butadiene latex type, styrene type, acrylic type or silicone type, thermoplastic rubbers, ABA block copolymers, butyl rubber, polyisobutylene, and vinyl ether polymers. Preferred of them are styrene type or acrylic type pressure-sensitive adhesives for their processability, storage stability, tack duration, and the properties of not transferring when touched.

The cleaning sheet 1 of the first embodiment is composed of a base sheet 11 and a wiping sheet 12 fixedly adhered to the surface of substantially the middle region of the base sheet 11. The wiping sheet 12 has trapezoidal cutouts corresponding to the shape of the recesses 10 from its front and the rear edges resulting in a shape made up of a strip part 12*a* lying in the widthwise middle and a row of triangles projecting from the strip part 12*a* to the front and the rear sides like tooth of a comb. That is, in the present embodiment, the recesses 10 are defined by (the thickness of) the end faces of the wiping sheet 12 and the exposed parts of the base sheet 11 right under the cutouts of the wiping sheet 12. The depth of the recess 10 is therefore the thickness of the wiping sheet 12. The fixing portions 1B are formed of the base sheet 11.

Any material that can be attached to the head 20 is useful as the base sheet 11. Taking into consideration ease of attachment to the head 20, capability of supporting the cleaning sheet 1, stiffness, and the like, preferred materials include fabric (woven or nonwoven), paper (including synthetic resin-mixed paper), elastic sheets, and resin films. It is particularly preferred to use a material having a pressure-sensitive adhesive layer on the area corresponding to the wiping portion 1A. The adhesive layer can be used to fix the wiping sheet 12 and also provides the tacky flat bottom 10*d* as such.

The base sheet 11 preferably has a basis weight of 5 to 100 g/m$^2$ for operationality, processability, stiffness, and flexibility. The base sheet 11 preferably has a thickness of 0.005 to 3 mm for operationality, processability, stiffness, and flexibility.

The wiping sheet 12 can be of any material that has been used as a cleaning sheet capable of trapping dust by entanglement in, or adsorption to, the fibers. Examples of the wiping sheet 12 include paper, nonwoven fabric, film, pile fabric, and the cleaning sheet disclosed in JP-A-7-184815, para. [0008]-[0018]. Also included is a sheet treated with a liquid containing one or more of oils (such as mineral oils, synthetic oils, and silicone oils) and surface active agents so as to exhibit dust adsorption attributed to the liquid.

The wiping sheet 12 preferably has a basis weight of 20 to 400 g/m$^2$ for operationality, processability, stiffness, and flexibility. The wiping sheet 12 preferably has a thickness of 0.5 to 10 mm, more preferably 1 to 7 mm, even more preferably 2 to 5 mm, for the depth of the recesses 10, operationality, processability, stiffness, and flexibility.

In the cleaning sheet 1 of the first embodiment, there is no edge extending in the length direction of the head 20 but the pointed shape 10*b* projecting to the front and to the rear of the head 20 between the borders 10*a*, which extend in the width direction of the wiping portion, of the adjacent recesses 10. Therefore, with the head 20 of a cleaning tool 2 applied to a surface to be cleaned (e.g., a floor) and moved to and fro to carry out usual sweeping operation, relatively large solid dust particles are led into the recesses 10 reaching the middle of the wiping portion 1A and trapped by the tack without fail. At the same time, hair and other dust and debris are caught by the surface of the wiping sheet 12.

FIGS. 4 through 15 illustrate the second to twelfth embodiments of the cleaning sheet according to the present invention. The parts and members in these figures that are the same as in the cleaning sheet 1 of the first embodiment are given the same numerals or references as in the first embodiment, and the description therefor is omitted. The description of the first embodiment applies appropriately to those particulars that are not referred to hereunder.

Figure 4:
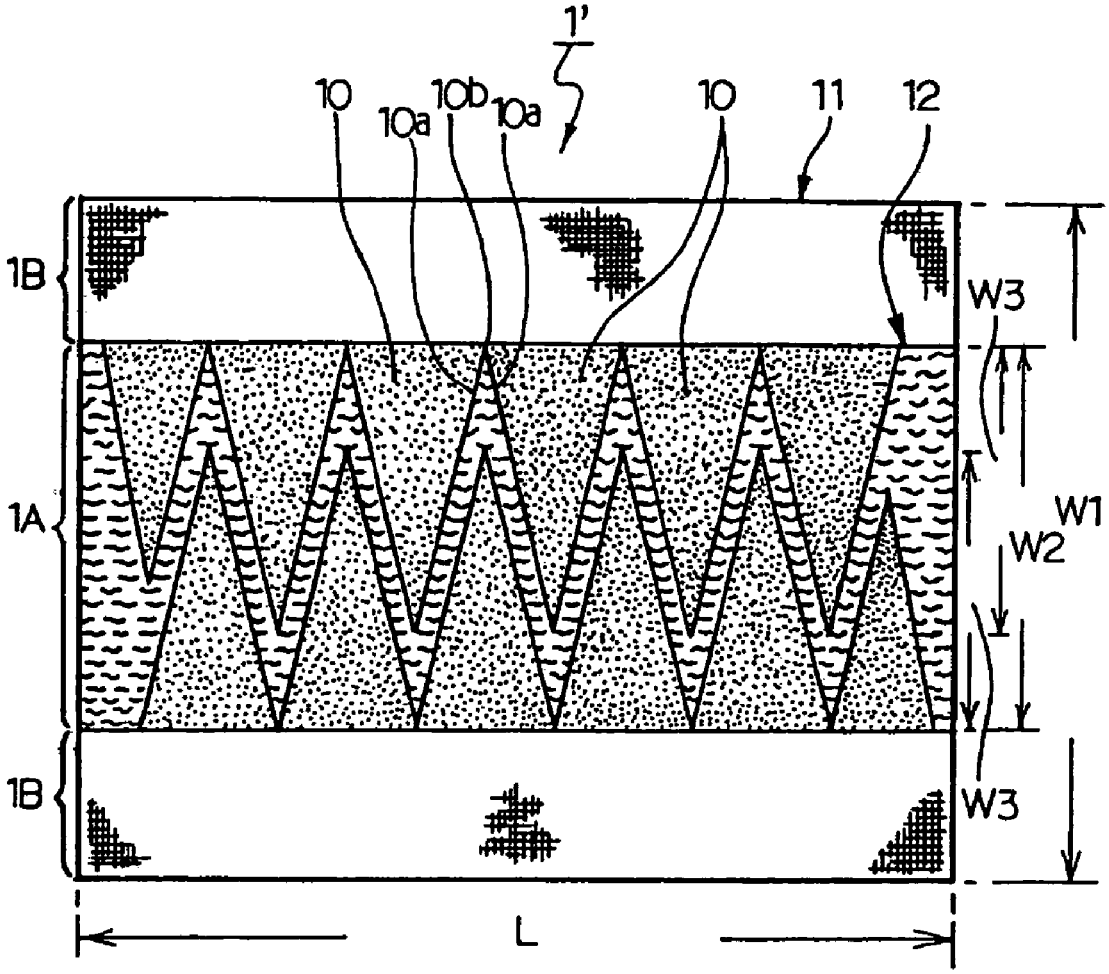
FIG. 4 is a plan schematically illustrating a second embodiment of the cleaning sheet according to the present invention (corresponding to FIG. 1).

The cleaning sheet of the present invention can have the area of the recesses 10 increased by increasing the length W3 of the recesses 10 in the width direction of the wiping portion so as to have increased dust collecting capacity as in the cleaning sheet 1' of the second embodiment shown in FIG. 4.

Figure 5:
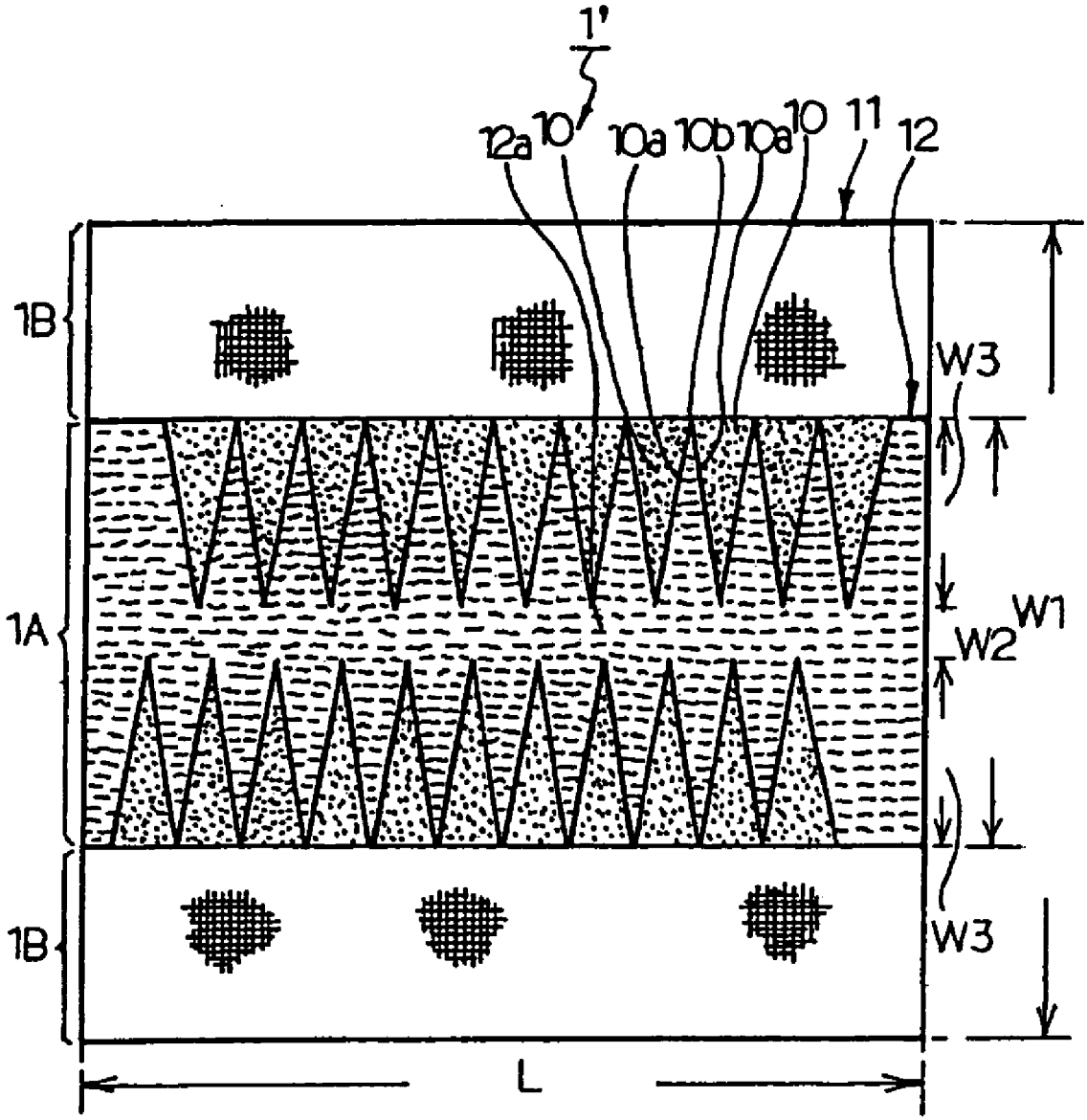
FIG. 5 is a plan schematically illustrating a third embodiment of the cleaning sheet according to the present invention (corresponding to FIG. 1).

The wiping sheet 12 may have isosceles-triangular cutouts from its front and the rear edges in its plan, resulting in formation of isosceles-triangular recesses 10 in the plan view as in the cleaning sheet 1' of the third embodiment shown in FIG. 5. The cleaning sheet 1' of the third embodiment offers the following effect as well as the effects of the cleaning sheet 1 of the first embodiment. Because the recesses 10 taper toward the middle of the wiping portion 1A, dust is squeezed into the narrow depth of the recesses 10 near the middle of the wiping portion 1A.

Figure 6:
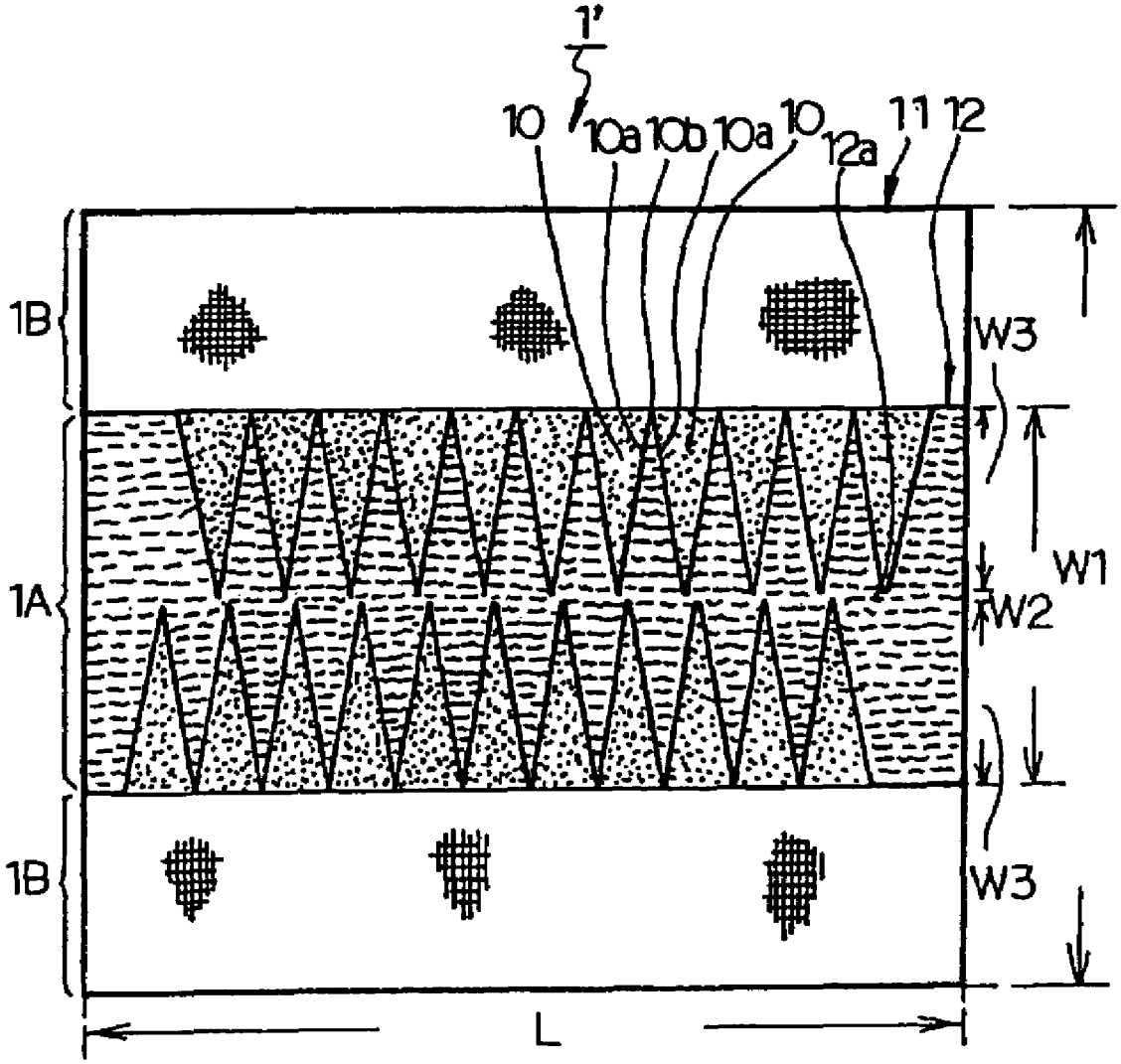
FIG. 6 is a plan schematically illustrating a fourth embodiment of the cleaning sheet according to the present invention (corresponding to FIG. 1).

The cleaning sheet 1' of the third embodiment may have the area of the individual recesses 10 increased by narrowing the strip part 12*a* lying in the widthwise middle of the wiping sheet 12 as in the cleaning sheet 1' of the fourth embodiment shown in FIG. 6. Because the recesses 10 extend nearer to the middle of the wiping portion 1A than in the third embodiment, the cleaning sheet 1' of the fourth embodiment has an advantage of collecting relatively large dust particles more than the cleaning sheet 1' of the third embodiment.

Figure 7:
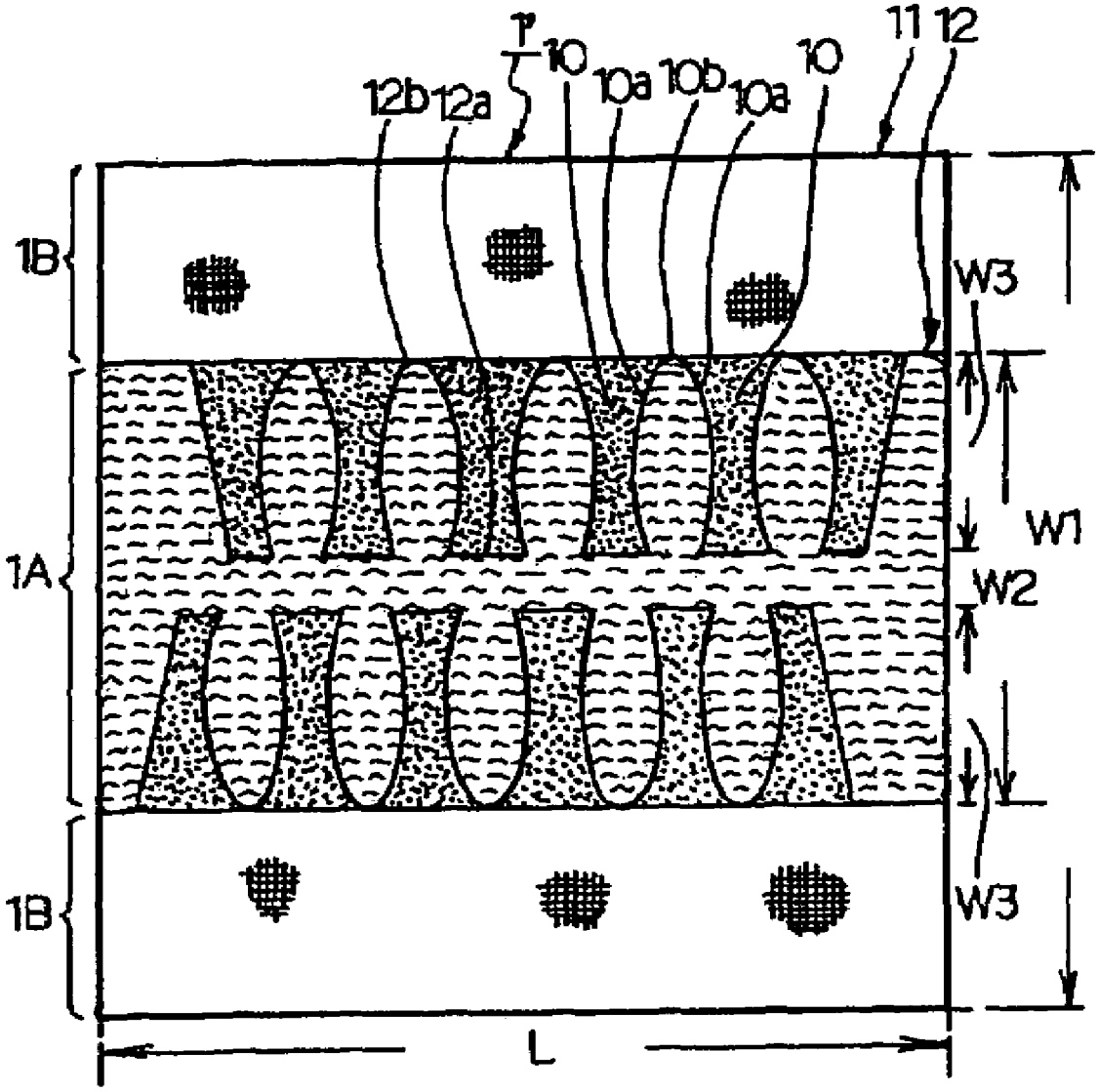
FIG. 7 is a plan schematically illustrating a fifth embodiment of the cleaning sheet according to the present invention (corresponding to FIG. 1).

As in the cleaning sheet 1' according to the fifth embodiment illustrated in FIG. 7, the wiping sheet 12 may be shaped to be composed of a strip part 12*a* extending along the widthwise middle and a row of elongated circles 12*b* partly projecting from the strip part 12*a* to the front and the rear sides with their major axis coinciding with the width direction. In the fifth embodiment, the recesses 10 are shaped to form a rounded shape 10*b* projecting to the front and to the rear between the borders 10*a* of adjacent recesses 10. Because the recesses 10 are so shaped as to once narrow from the widthwise middle of the wiping portion 1A toward the opening mouth and then broaden, the cleaning sheet 1' of the fifth embodiment produces the following advantages as well as the effects of the first embodiment. The dust trapped near the widthwise middle of the wiping portion 1A is prevented from getting out. The cleaning sheet has increased capacity for collecting relatively large dust particles near the middle portion thereof.

Figure 8:
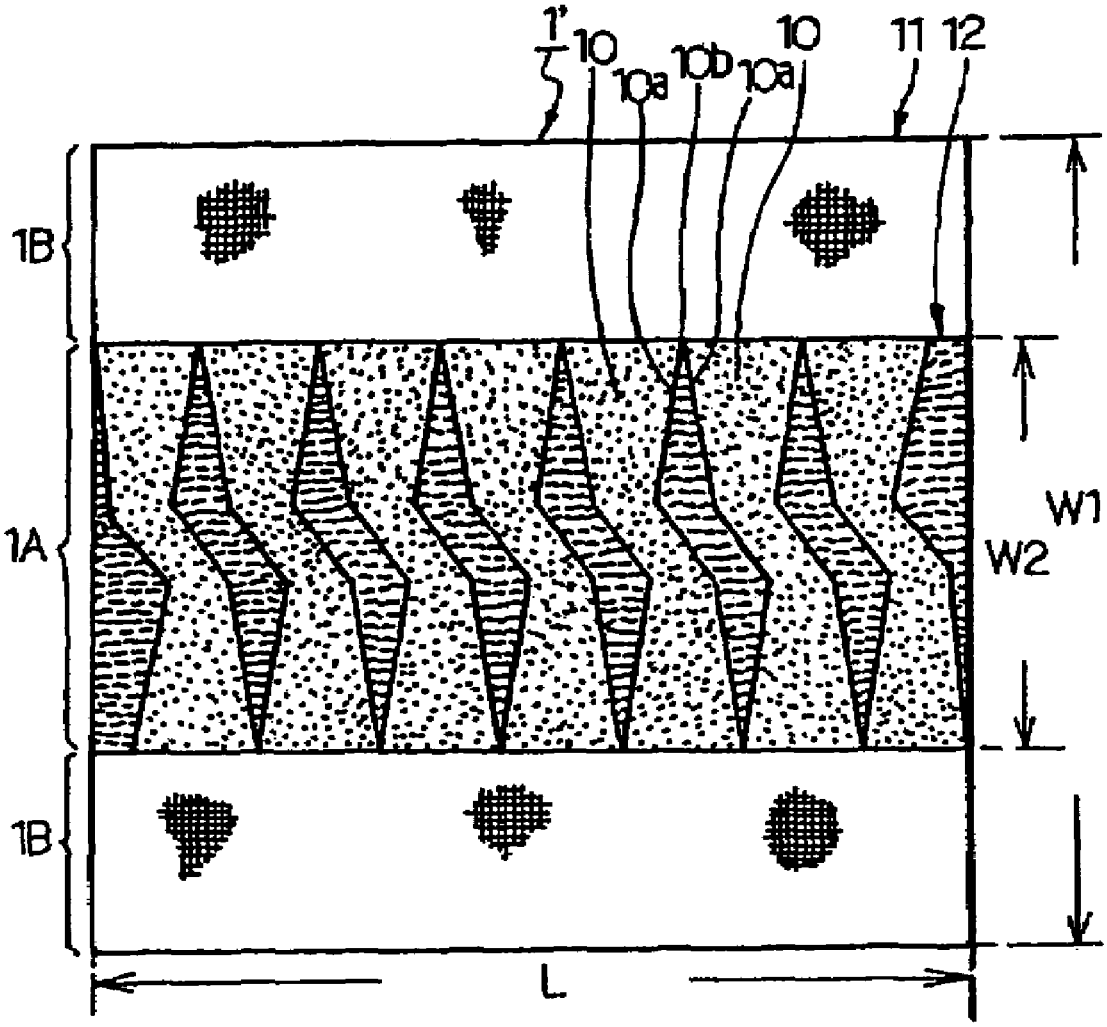
FIG. 8 is a plan schematically illustrating a sixth embodiment of the cleaning sheet according to the present invention (corresponding to FIG. 1).

As in the cleaning sheet 1' of the sixth embodiment shown in FIG. 8, the wiping sheet 12 may have no strip part 12*a*, and the recesses 10 of the front row may be interconnected to the recesses 10 of the rear row in such a configuration that the interconnected recesses 10 are impenetrable from the front or the rear. According to this design, the recesses 10 can have increased area, and relatively large dust particles can be collected even in the widthwise middle of the wiping portion 1A. Since the recesses 10 are impenetrable from the front or the rear, the dust once collected in the recess is not allowed to get through.

Figure 9:
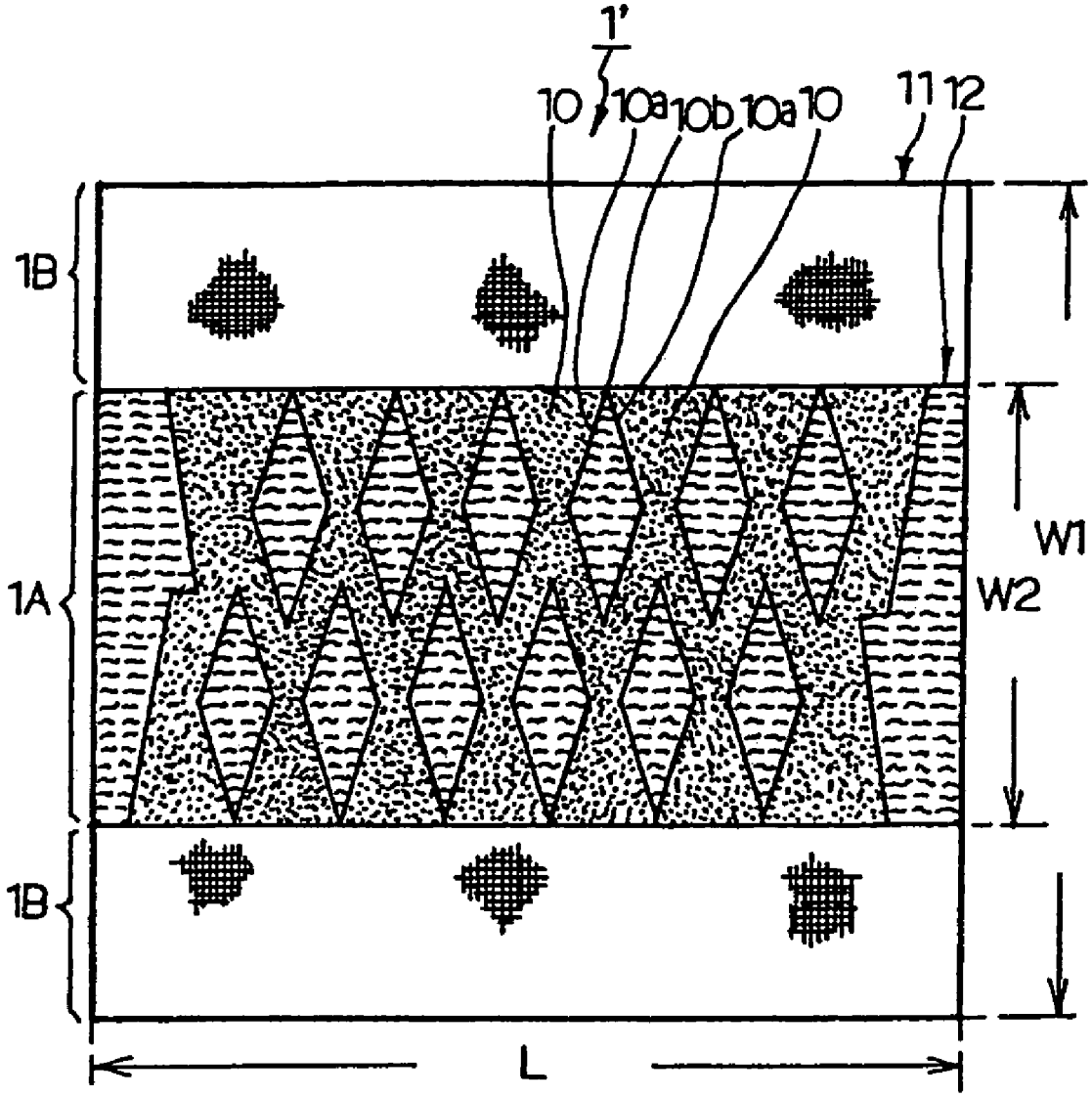
FIG. 9 is a plan schematically illustrating a seventh embodiment of the cleaning sheet according to the present invention (corresponding to FIG. 1).

As in the cleaning sheet 1' of the seventh embodiment illustrated in FIG. 9, the wiping part 1A may be designed such that there is no strip part 12*a* and that diamond-shaped (parallelogramic) pieces of the wiping sheet 12 are fixed on the base sheet 11 in a diamond lattice pattern instead of the comb tooth-like arrangement of the first embodiment. This arrangement results in formation of rows of recesses in the front and the rear sides, interconnected in such a configuration that the recesses 10 are impenetrable from the front or the rear, with pointed shapes 10*b* between adjacent borders 10*a* of adjacent recesses 10. According to the seventh embodiment, the cleaning sheet 1' is capable of collecting and trapping relatively large dust particles almost uniformly in the width direction of the wiping portion 1A.

Figure 10:
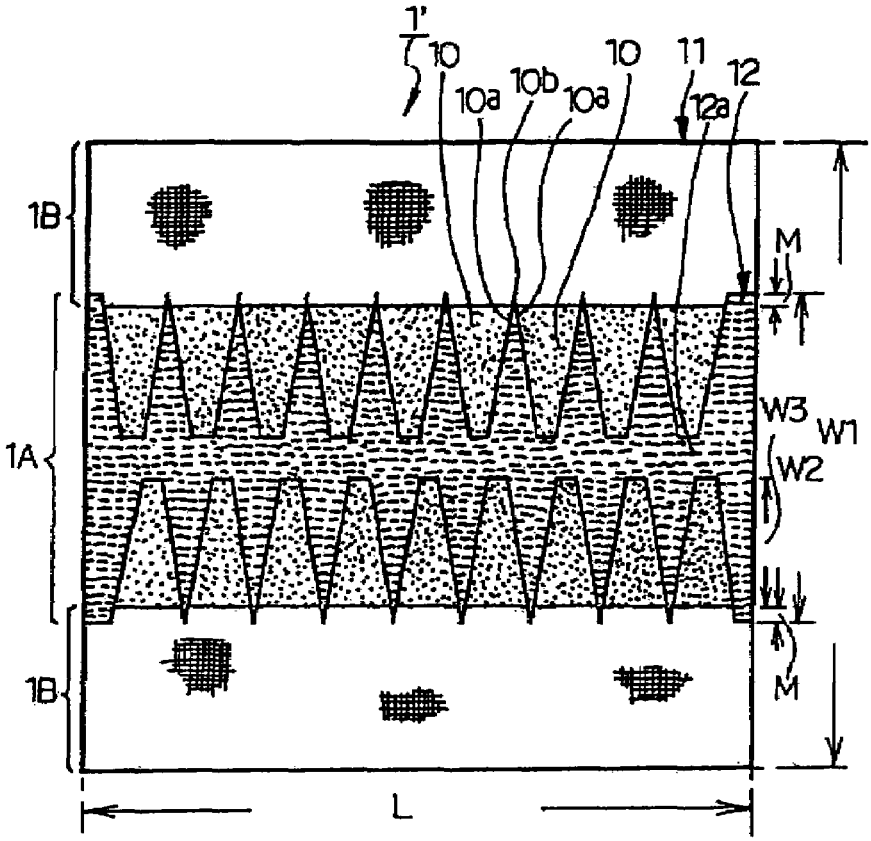
FIG. 10 is a plan schematically illustrating an eighth embodiment of the cleaning sheet according to the present invention (corresponding to FIG. 1).
Figure 11:
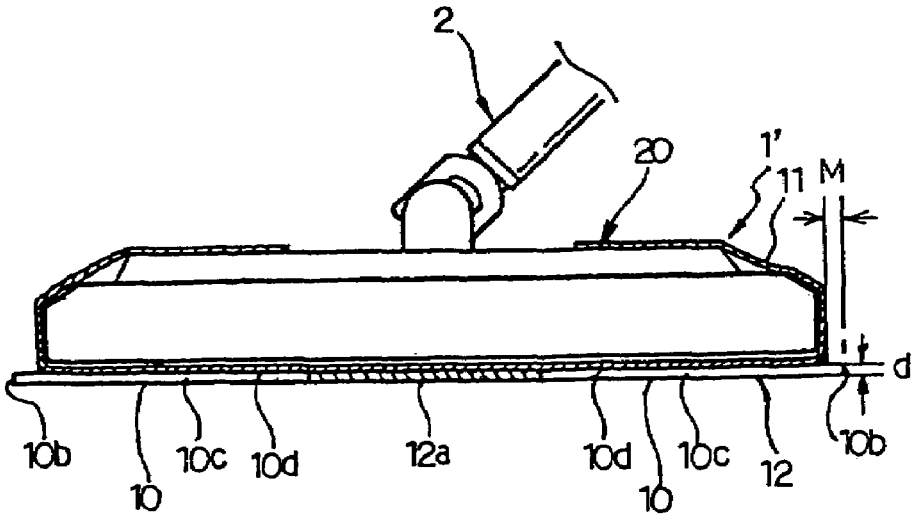
FIG. 11 is a schematic transverse cross section of an eight embodiment of the cleaning sheet according to the present invention in the state attached to the head of a cleaning tool (corresponding to FIG. 2).

As in the cleaning sheet 1' of the eighth embodiment illustrated in FIGS. 10 and 11, the cleaning sheet of the present invention may have the apices of the pointed shapes 10*b* may stick out from the leading (front) and tailing (rear) edges of the head 20 so that these sticking parts may be applied to the wall or the floor at corners to sweep and catch up relatively large dust particles. The projecting length M of the pointed shapes 10*b* is selected appropriately according to the material of the wiping sheet 12. It is preferably within 20 mm, more preferably within 10 mm, in view of the performance of sweeping fine and relatively large dust particles, fabricability, and ease of attaching to the head 20.

Figure 12:
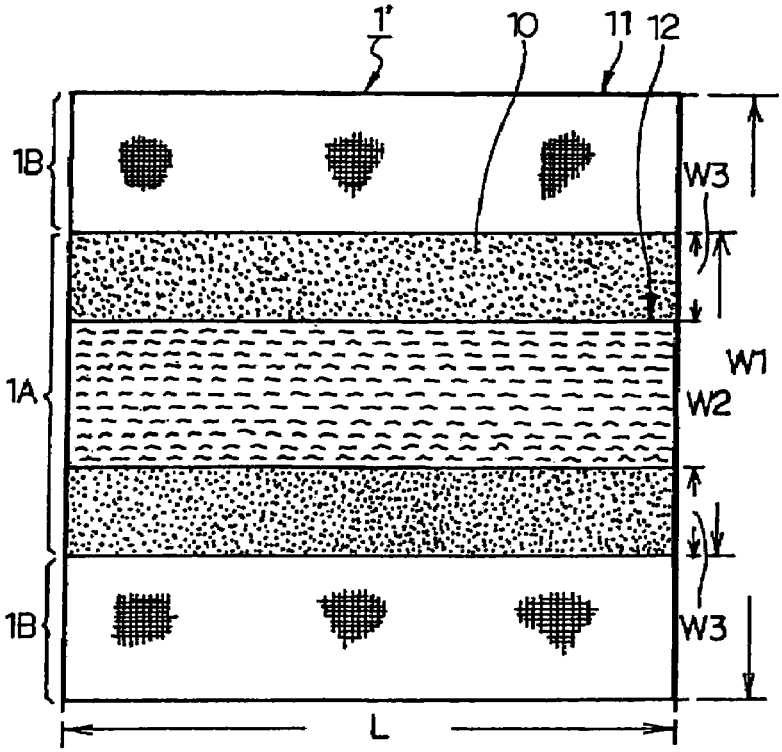
FIG. 12 is a plan schematically illustrating a ninth embodiment of the cleaning sheet according to the present invention (corresponding to FIG. 1).

As in the ninth embodiment illustrated in FIG. 12, the cleaning sheet of the present invention may be designed such that the wiping portion 1A, which is adapted to be disposed on the lower side of the head when attached, has a tacky recess 10 having a prescribed width W3 and extending in the length direction of the head, i.e., the length L direction of the cleaning sheet 1'. The width W3 (i.e., the length or depth of the recess 10 from the edge of the head in the width direction of the wiping portion 1A) is preferably 3 to (0.3×W1) mm, more preferably 10 to (0.2×W1) mm. According to the ninth embodiment, the cleaning sheet 1' is capable of trapping large dust particles lying with their length parallel to the head because of its continuous tacky portions.

Figure 13:
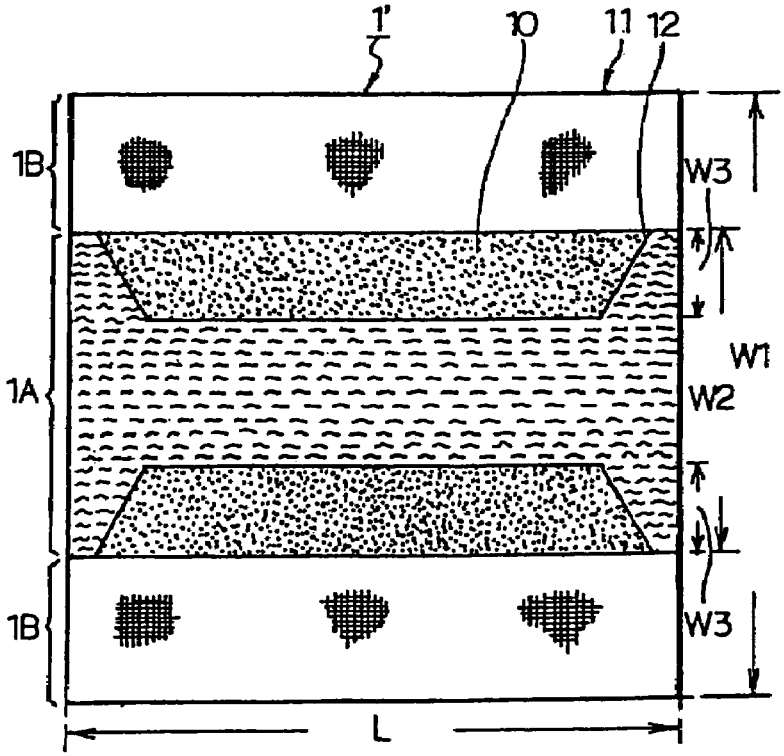
FIG. 13 is a plan schematically illustrating a tenth embodiment of the cleaning sheet according to the present invention (corresponding to FIG. 1).

As in the cleaning sheet 1' of the tenth embodiment shown in FIG. 13, the wiping sheet 12 may be present by the side of both ends of the recess 10. The tenth embodiment secures sweeping operation stability as well as provides the effects of the ninth embodiment.

Figure 14:
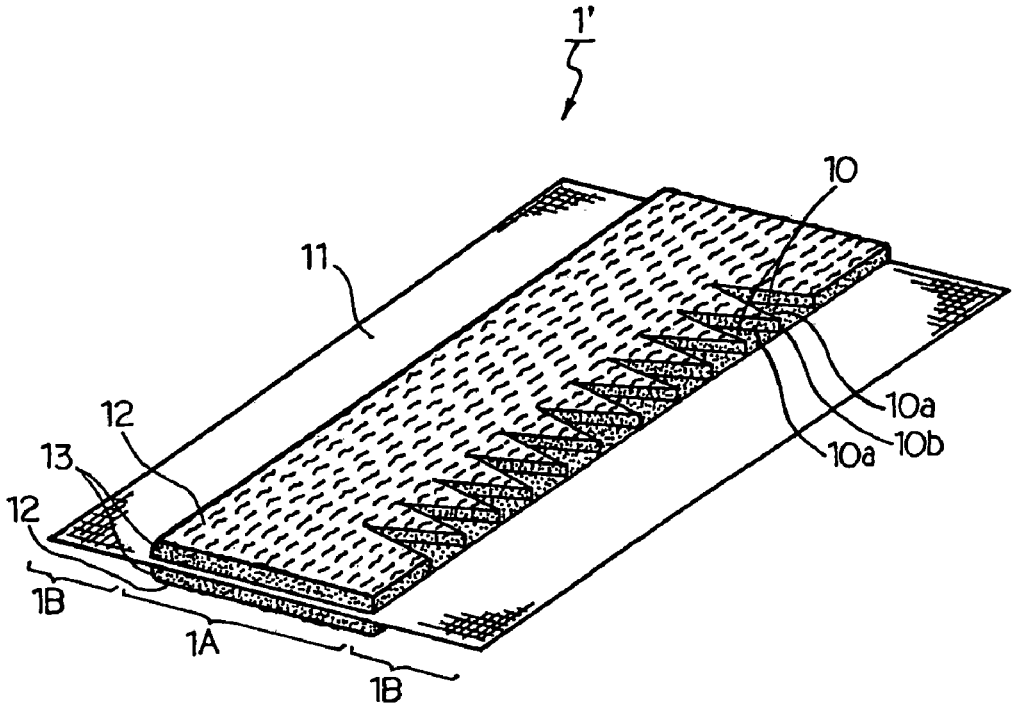
FIG. 14 is a perspective schematically illustrating a eleventh embodiment of the cleaning sheet according to the present invention.

The cleaning sheet of the present invention can be configured to be double-sided reversible by fixing the wiping sheet 12 to both sides of the base sheet 11 via an intermediate member 13 as in the eleventh embodiment illustrated in FIG. 14. In the cleaning sheet 1' of the eleventh embodiment, the intermediate member 13 is preferably formed of pulp, nonwoven fabric, paper, film, piled fabric, sponge, rubber, etc. The wiping sheet 12 may be fixed on both sides of the base sheet 11 without using the intermediate member 13.

Figure 15:
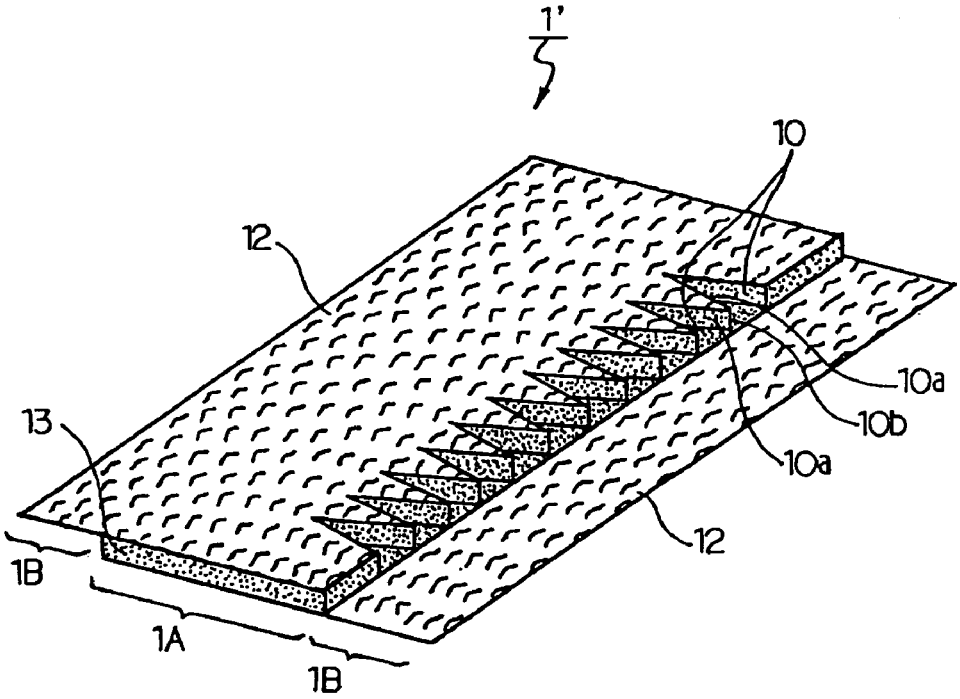
FIG. 15 is a perspective schematically illustrating a twelfth embodiment of the cleaning sheet according to the present invention.

The cleaning sheet of the present invention can be configured to be double-sided reversible by fixing the wiping sheet 12 to both sides of an intermediate member 13 in symmetry as in the twelfth embodiment illustrated in FIG. 15. It is preferred that each of the wiping sheets 12 on the upper and the lower sides of the intermediate member 13 not only function as a wiping portion 1A but extend from one side edge of the intermediate member 13 to provide a fixing portion 1B and that a plurality of recesses 10 be formed on the other side of the wiping portion 1A. The upper and the lower wiping sheets 12 extend in opposite directions (to the front and to the rear in this embodiment).

Figure 16:
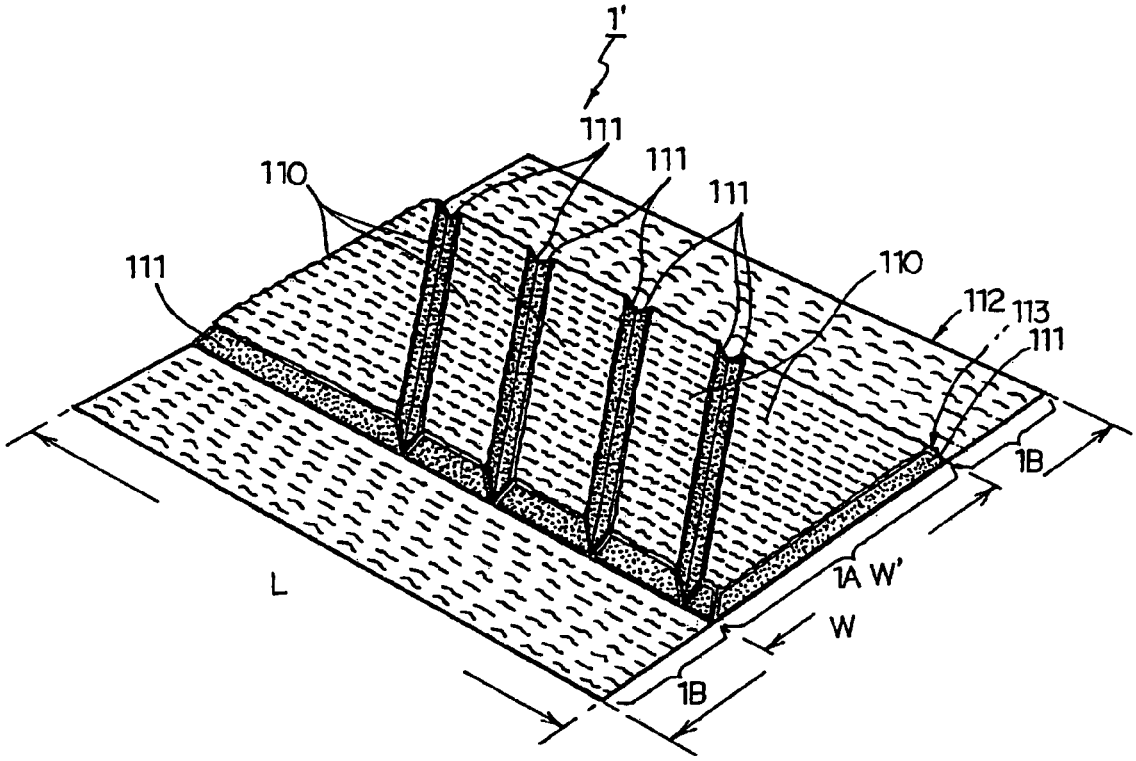
FIG. 16 is a perspective schematically illustrating a thirteenth embodiment of the cleaning sheet according to the present invention.
Figure 17:
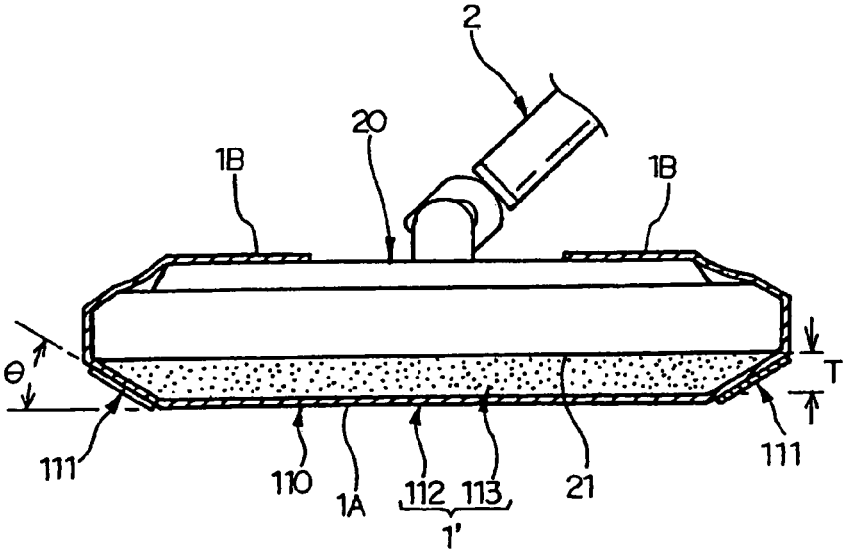
FIG. 17 is a schematic transverse cross section of the cleaning sheet of the thirteenth embodiment in the state attached to the head of a cleaning tool.

FIG. 16 and 17 illustrate another embodiment of the cleaning sheet according to the present invention. FIG. 17 shows the cleaning sheet attached to the head of a cleaning tool. In the figures, numerals 1' and 2 indicate the cleaning sheet and the cleaning tool, respectively.

As shown in FIG. 16, the cleaning sheet 1' has a rectangular shape in its plan view. The cleaning sheet 1' has a wiping portion 1A and fixing portions 1B located on both sides of the wiping portion 1A. In the state attached to the head 20 of the cleaning tool 2 as illustrated in FIG. 17, the wiping portion 1A is disposed on the lower side of the head 20, and the fixing portions 1B are fixed to the upper side of the head 20.

While the cleaning sheet 1' is not particularly limited in size and shape, it is preferred that both length L and width W' fall within ±30% of the length and the width, respectively, of the lower side of the head 20 of the cleaning tool 2. As the area of the head 20 of the cleaning tool 2 increases, the wiping portion 1A of the cleaning sheet 1' should have an accordingly increased area.

For general domestic applications, the length L is preferably 170 to 340 mm, and the width W1 of the wiping portion is preferably 70 to 130 mm. The area of the wiping portion 1A is preferably 120 to 440 $cm^2$.

The wiping portion 1A, in the state attached to the head 20, consists of a flat part 110 and tacky sloped parts 111 rising from the flat part 110. Both the flat part 110 and the sloped parts 111 are disposed substantially along the lower side 21 of the head 20. The angle θ (see FIG. 17) of each sloped part 111 is preferably 1° to 60°, more preferably 3° to 45°, in view of the size of dust to be trapped and wiping operationality.

The area of the flat part 110 is preferably 30% to 95%, more preferably 50% to 90%, even more preferably 60% to 80%, of the area of the wiping portion 1A, considering the balance between the capability of trapping hair, soil dust, etc. and the capability of trapping relatively large dust particles.

In the present embodiment, the wiping portion 1A has the sloped parts 111 along all its periphery and obliquely across the flat part 110. The sloped parts 111 along the periphery of the wiping portion 1A trap relatively large dust particles as well as hair, soil dust, etc. with their tackiness as the head of the cleaning tool 2 is slid in a usual wiping operation. The cleaning sheet traps dust on not only the peripheral sloped parts but the sloped parts 111 obliquely across the flat part 110, thereby having an increased dust collecting capacity.

The sloped parts 111 have tackiness (tack). A pressure-sensitive adhesive described infra is applied either all over the surface of the sloped parts 111 or in various patterns (e.g., in dots).

The tack of the sloped parts 111 is preferably 1 to 30, more preferably 3 to 28, even more preferably 5 to 25, as expressed in terms of ball number (i.e., the nominal diameter of a ball multiplied by 32) in the rolling ball tack test specified in JIS Z0237 14 (test methods of pressure-sensitive adhesive tapes and sheets). Too low tack results in a failure to trap the dust that has not been trapped by the cleaning portion. If the tack is too high, the sloped part can strongly stick to the surface to be cleaned and hardly separate, which impairs the operationality.

The pressure-sensitive adhesives which impart tack to the sloped parts 111 include those of natural rubber type, styrene-butadiene latex type, styrene type, acrylic type or silicone type, thermoplastic rubbers, ABA block copolymers, butyl rubber, polyisobutylene, and vinyl ether polymers. Preferred of them are styrene type or acrylic type pressure-sensitive adhesives for their processability, storage stability, tack duration, and the properties of not transferring when touched.

As shown in FIG. 17, the cleaning sheet 1' is formed of a base sheet 112 and a bulky member 113 fixedly adhered to the base sheet 112.

The base sheet 112 can be of any material that has been used in a cleaning sheet capable of trapping dust by entanglement in, or adsorption to, the fibers. Examples of the base sheet 112 include paper, nonwoven fabric, film, pile fabric, and the cleaning sheet disclosed in JP-A-7-184815, para. [0008]-[0018]. Also included is a sheet treated with a liquid containing one or more of oils (such as mineral oils, synthetic oils, and silicone oils) and surface active agents so as to exhibit dust adsorption attributed to the liquid.

The base sheet 112 preferably has a basis weight of 5 to 100 g/m$^2$ for operationality, processability, stiffness, and flexibility. The base sheet 112 preferably has a thickness of 0.005 to 3 mm for operationality, processability, stiffness, and flexibility.

The bulky member 113 has a trapezoidal cross section composed of a flat part and sloped parts corresponding to the aforementioned flat part 110 and sloped parts 111. The base sheet 112 is fixed along the faces of these parts to provide the flat part 110 and the sloped parts 111.

The bulky member 113 is preferably of a material that has desired bulk, provides sloping faces corresponding to the sloped parts 111, and allows for fixing the base sheet 112 on itself. Such a material includes pulp, nonwoven fabric, paper, film, pile fabrics, sponge, expanded styrene, and rubber sheets. Two or more materials properly selected therefrom may be stacked to make the bulky member 113.

The thickness T of the bulky member 113 is decided appropriately according to the size of dust and debris to be caught up. It is preferably 0.5 mm or greater for catching sand or like dust of 0.5 to 1 mm in diameter, or 3 mm or greater for trapping rice grains or like particles of 3 to 5 mm in diameter.

With the head 20 of the cleaning tool 2 applied to a surface to be cleaned (e.g., a floor) and moved to and fro to carry out usual sweeping operation, the cleaning sheet 1' of the present embodiment entraps relatively large solid dust particles on the sticky surface of the sloped parts 111 and catches fine dust (e.g., house dust), hair, etc. on the surface of the flat part 110 of the wiping portion 1A. Having sloped parts 111 obliquely across the flat part 110, the cleaning sheet 1' has an increased capacity of collecting relatively large solid dust particles.

Figure 18:
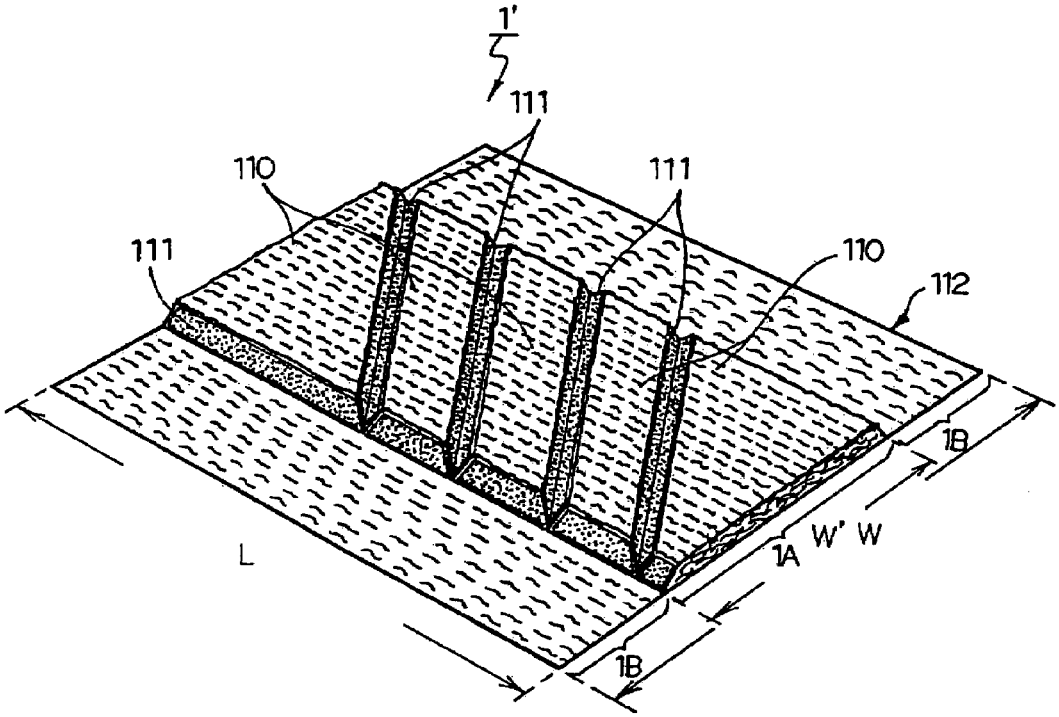
FIG. 18 is a perspective schematically illustrating a fourteenth embodiment of the cleaning sheet according to the present invention (corresponding to FIG. 16).

FIG. 18 illustrates the fourteenth embodiment of the cleaning sheet according to the present invention. The parts and members in FIG. 18 that are the same as in the thirteenth embodiment are given the same numerals or references as in the thirteenth embodiment, and the description therefor is omitted. The description of the thirteenth embodiment applies appropriately to those particulars that are not referred to hereunder.

The cleaning sheet 1' of the second embodiment shown in FIG. 18 is formed of a single member, a sheet 112. The sheet 112 has a thick bulky wiping portion 1A and thin fixing portions 1B. The wiping portion 1A has a sloped part 111 along its front and rear edges and sloped parts 111 obliquely across the flat part 110. These sloped parts 111 are provided with tackiness. The sloped parts 111 can be formed by, for example, embossing the sheet 112 or producing the sheet 112 by molding process, air-laying process or patternwise fiber accumulation. The sheet 112 can be of the same material as the material of the base sheet 112 of the first embodiment.

The wiping portion 1A has a basis weight of 15 to 1000 g/m$^2$, preferably 50 to 300 g/m$^2$, and a thickness of 0.5 to 30 mm, preferably 3 to 10 mm. The fixing portions 1B preferably have a basis weight of 5 to 100 g/m$^2$ and a thickness of 0.005 to 3 mm. The cleaning sheet 1' of the present embodiment produces the following advantages in addition to the advantages of the thirteenth embodiment. The cleaning sheet 1' is light, flexible, and easier to use in cleaning operation. It is produced through a fewer processing steps at lower cost.

The present invention is by no means limited to the foregoing embodiments, and various changes and modifications can be made therein without departing from the spirit and scope thereof.

The cleaning sheet of the present invention may be configured otherwise than in the foregoing embodiments as long as the wiping portion has no edge extending in the length direction of the head but a pointed or curved shape projecting to the front and the rear between adjacent borders of adjacent recesses open to the front and the rear. For instance, the side edge of the wiping sheet may be shaped to have a combination of the triangles and the elongated circles to make recesses. The elongated circles of the side edge in FIG. 7 may be replaced with parallelograms. The parallelogramic pieces of the wiping sheet shown in FIG. 9 may be replaced with elliptical pieces of the wiping sheet fixed to the base sheet to make recesses.

The cleaning sheet of the present invention preferably has a laminate structure in which the wiping sheet 112, is fixed on the base sheet 111 as in the first embodiment. Otherwise a single sheet may be shaped to have desired recesses by embossing, changing the basis weight of prescribed parts, accumulating fibers on prescribed parts, or heat sealing, and tackiness is imparted to the recesses thus formed as described earlier.

While it is preferred for each recess 10 (or 110) to exhibit tack on both the inner wall 10*c* and the flat bottom 10*d* as in the foregoing embodiments, tackiness may be imparted to either one of the inner wall 10 (or 110) and the flat bottom 10*d*.

While it is preferred that the recesses 110 be formed in one (see FIG. 14) or both of the front and the rear edges as in the foregoing embodiments, they may be formed on either one or both of the left and the right edges (longitudinal ends).

The cleaning sheet of the present invention preferably has the tip of the pointed or curved shape positioned nearly at the front or rear edge of the head or stuck out from the front or rear edge of the head as in the foregoing embodiments. Otherwise, the tip of the pointed or curved shape may be positioned inward from the front, rear, left or right edge of the head of a cleaning tool.

The fixing portions of the cleaning sheet according to the present invention are not limited to the configurations described in the foregoing embodiments and can be altered in accordance with the design of the head of a cleaning tool.

For example, while in the foregoing embodiments the fixing portions 1B are formed of the base sheet 111 per se, tackiness may be imparted to the surface of the base sheet whereby the base sheet may be removably attached to the head of a cleaning tool.

Figure 19:
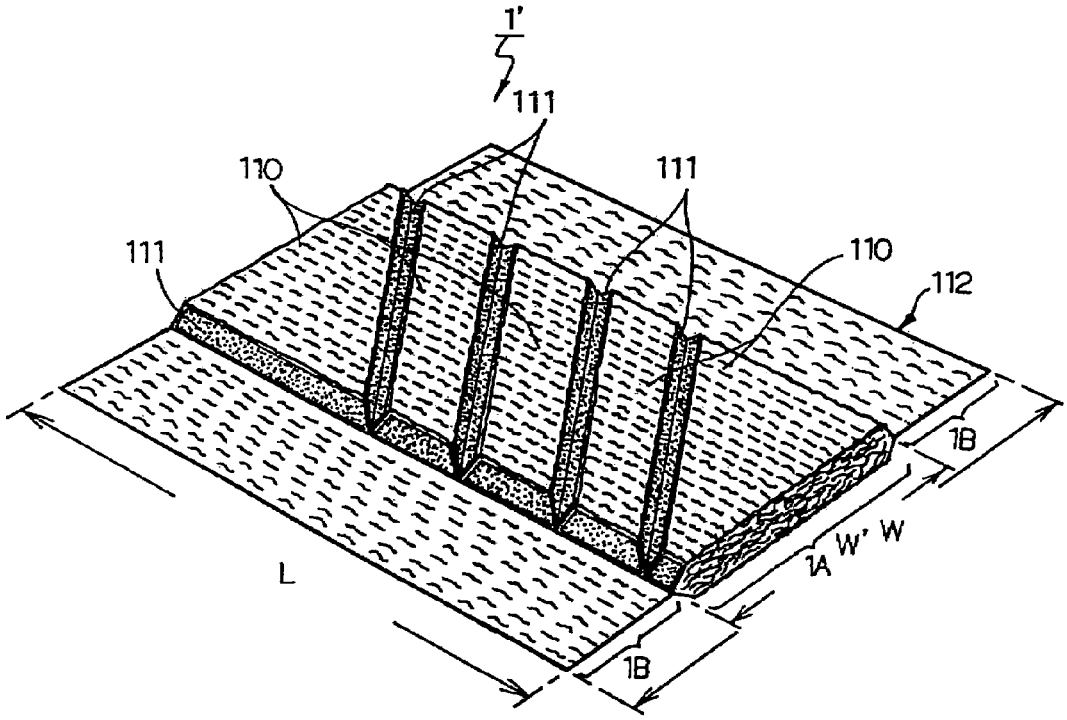
FIG. 19 is a perspective schematically illustrating another embodiment of the cleaning sheet according to the present invention.

In another embodiment, the base sheet 111 is shaped to provide a plurality of tags 11*a* sticking out of the front and the rear edges and serving as fixing portions 1B as in the cleaning sheet 1' illustrated in FIG. 19 (in the particular case of FIG. 19, two tags 11*a* for each of the front and the rear edges). The tags 11*a* are attached to the head to fix the cleaning sheet. The cleaning sheet 1' of this embodiment has the following advantages. When the wiping sheet 112 is longer than the head of a cleaning tool, waste of the base sheet can be avoided. The fixing portions are prevented from sticking to the recesses 110.

Thus, the fixing portions are not restricted in shape and material as long as they allow for attaching and fixing the cleaning sheet to the head of a cleaning tool. In still another embodiment, the cleaning sheet may have a plurality of strings sticking out of the base sheet and serving as fixing portions, and the strings are tied on the head to fix the cleaning sheet to the head. In yet another embodiment, a plurality of elastic members, such as rubber strings, are provided to connect the front and the rear edges or the left and the right edges of the base sheet. The elastic members are put over the head to attach the cleaning sheet to the head.

Figure 20:
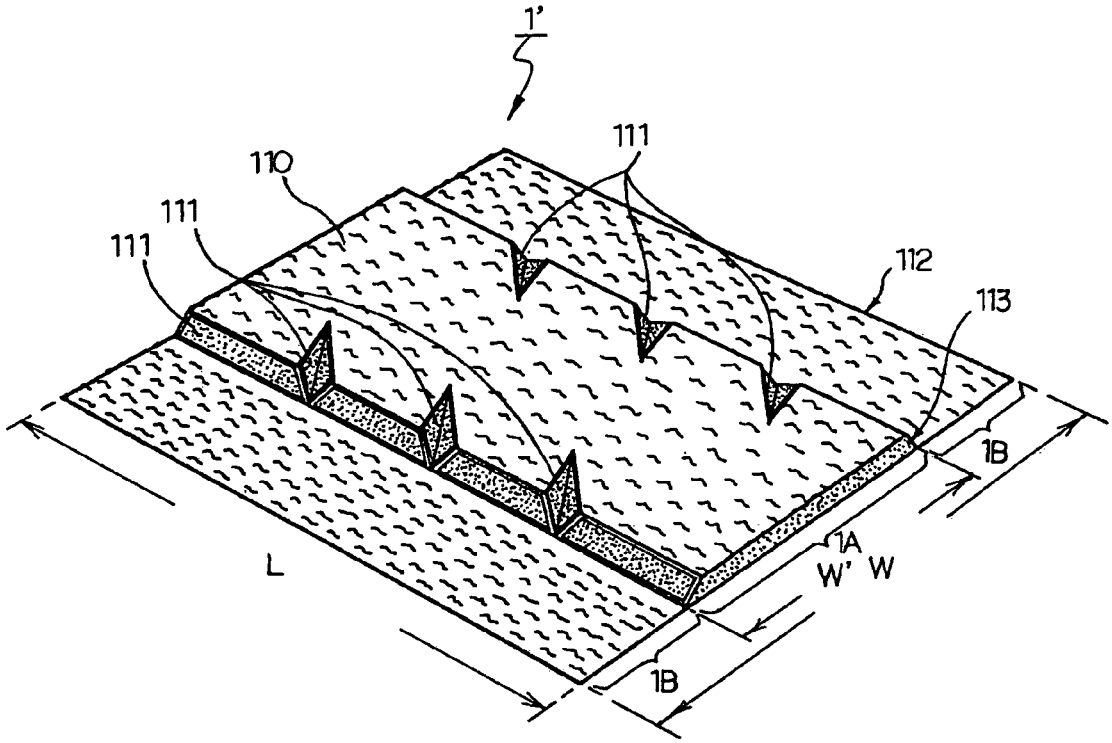
FIG. 20 is a perspective schematically illustrating still another embodiment of the cleaning sheet according to the present invention (corresponding to FIG. 16).

While the cleaning sheets of the foregoing embodiments are single-sided, the cleaning sheet may be made double-sided reversible as in the embodiment illustrated in FIG. 20. The cleaning sheet 1' of this embodiment is formed of a single base sheet 112 with its wiping portion 1A being made thick to bulge both upward and downward so that the cleaning sheet can be reversed after one side is soiled.

It suffices that the sloped or curved part is provided along at least one of the front, rear, left, and right edges of the wiping portion. The sloped or curved part is preferably provided along the front and the rear edges and also across the flat part of the wiping portion 1A as in the first embodiment but may be provided only along the edge or across the flat part.

Figure 21:
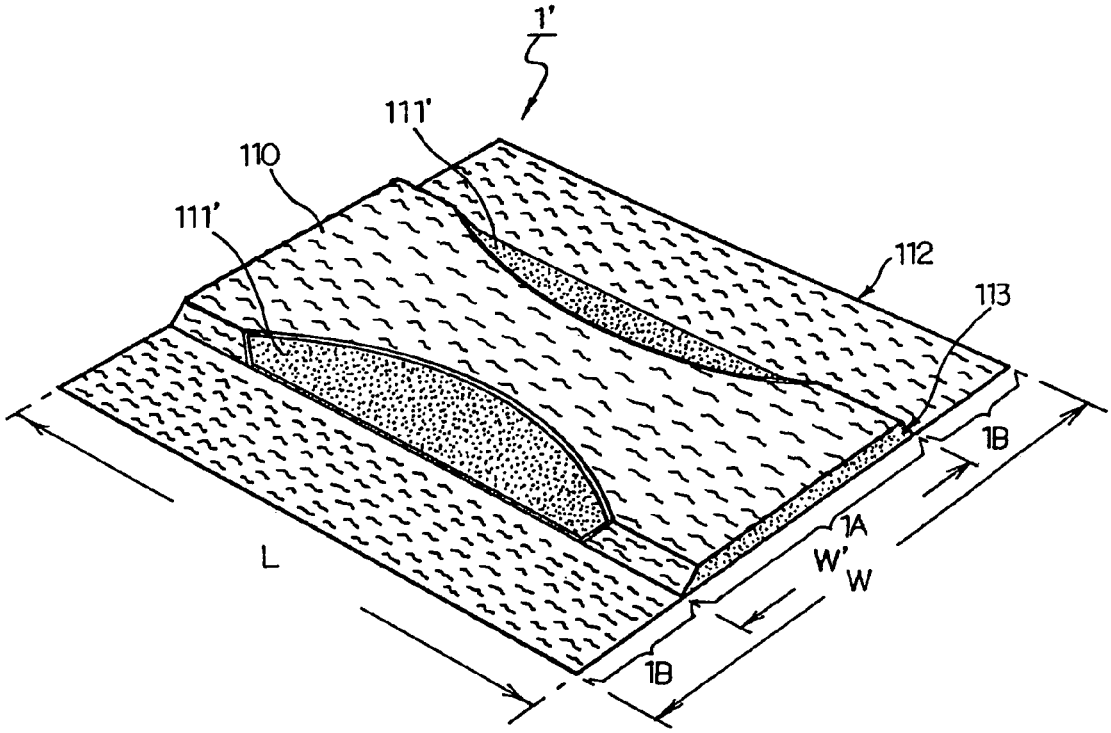
FIG. 21 is a perspective schematically illustrating yet another embodiment of the cleaning sheet according to the present invention (corresponding to FIG. 16).

The sloped (or curved) part 111 in the flat part 110 of the wiping portion 1A is preferably configured to divide the flat part 110 as in the first embodiment. It is also possible that sloped parts 111 starting from the front and the rear edges of the flat part 110 extend inward by a prescribed length but not to divide the flat part 110 as in the cleaning sheet 1' of the embodiment illustrated in FIG. 21. This embodiment allows for increasing the sloped area without largely reducing the flat area. As a result, the cleaning sheet exhibits improved balance between the performance of trapping hair and soil dust and the performance of trapping relatively large solid dust particles and surely catches up dust irrespective of the wiping direction.

Figure 23:
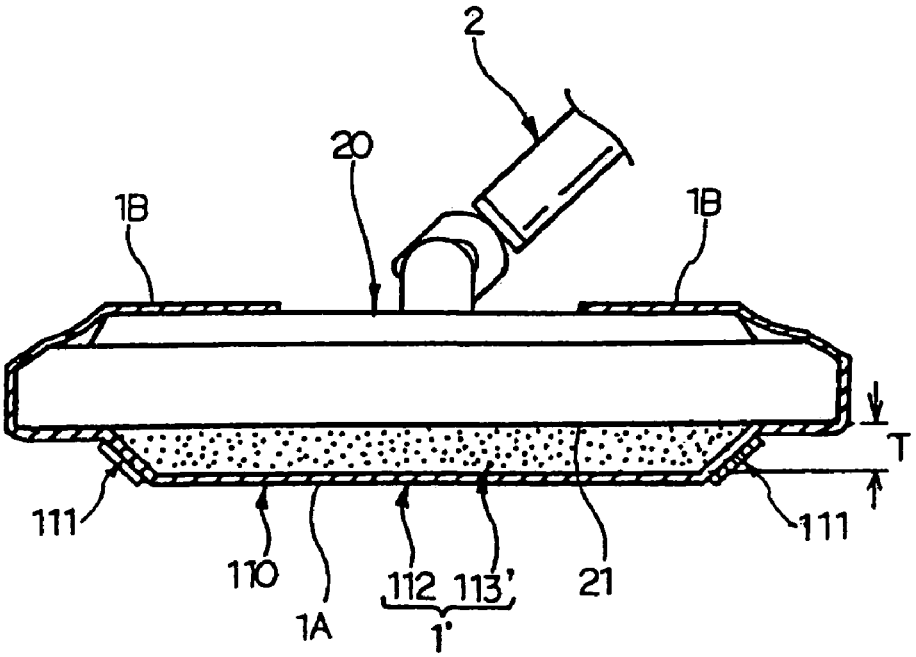
FIG. 23 is a schematic transverse cross section of still another embodiment of the cleaning sheet according to the present invention in the state attached to the head of a cleaning tool (corresponding to FIG. 17).
Figure 24:
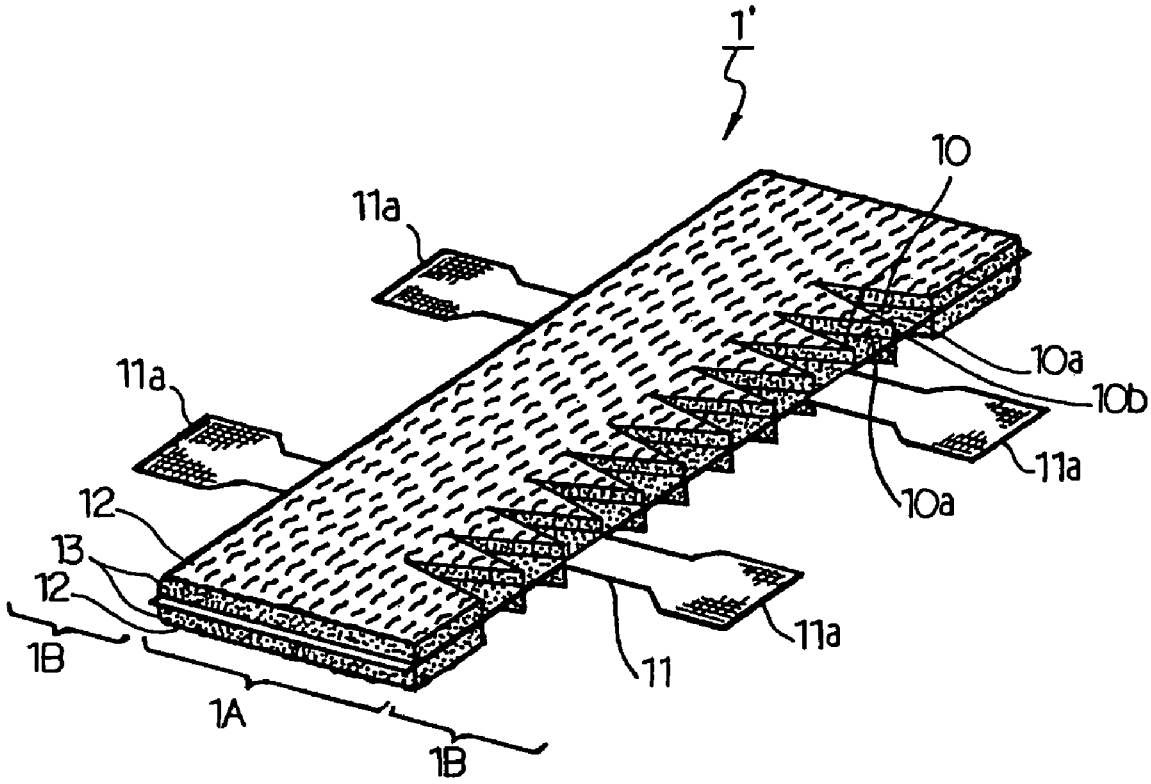
FIG. 24 is a perspective schematically illustrating still yet another embodiment of the cleaning sheet according to the present invention (corresponding to FIG. 14).

The cleaning sheet of the present invention preferably has the sloped part 111 rising from the flat part 110 along each of the front and the rear edges of the wiping portion 1A. The sloped part 111 may be replaced with an inwardly curved part 111' rising from the flat part 110 as in the cleaning sheet 1' of the embodiment shown in FIG. 23. The cleaning sheet 1' of this embodiment surely catches up dust irrespective of the wiping direction. The wiping portion 1A has an increased area of the tacky surface (curved parts 111') while the front and the rear edges of the flat part 110 adjacent to both ends of the curved parts 111' secure stability of the wiping operation. Two or more curved parts 111' may be provided along one edge of the wiping portion 1A.

Figure 22:
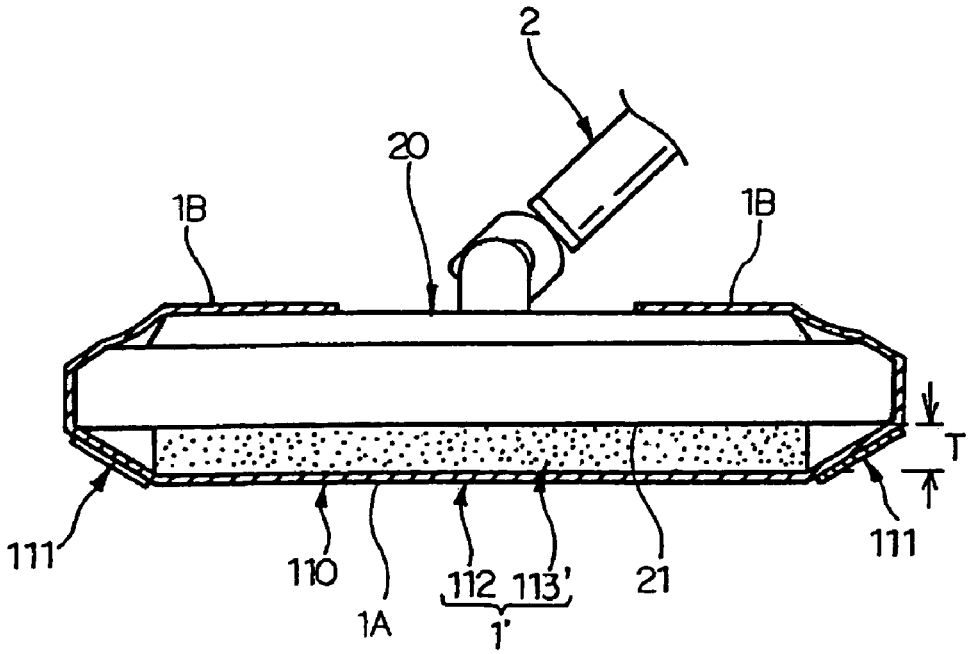
FIG. 22 is a schematic transverse cross section of another embodiment of the cleaning sheet according to the present invention in the state attached to the head of a cleaning tool (corresponding to FIG. 17).

It is preferred that the bulky member 113 of the cleaning sheet according to the present invention have faces corresponding to the flat part 110 and the sloped parts 111 as in the first embodiment. Nevertheless, the bulky member does not always have to have faces corresponding to the sloped parts. For example, the cleaning sheet may have the configuration of the cleaning sheet 1' illustrated in FIG. 22, in which the bulky member 113' has a rectangular cross-section. With the cleaning sheet 1' attached to the head 20 of the cleaning tool 2, there are formed shoulders between the head 20 and the bulky member 113', and sloped parts 111 are thus created over the shoulders along the edges of the wiping portion 1A. According to this embodiment, the sloped parts 111 provide an enhanced cushioning effect, whereby the cleaning sheet 1' traps dust while being deformed in conformity to the uneven contour of a corner between a floor and a door, a threshold or sill, an antiskid, etc. The dust particles once trapped are, not being strongly pressed to an object to be cleaned, prevented from scratching the object.

Figure 25:
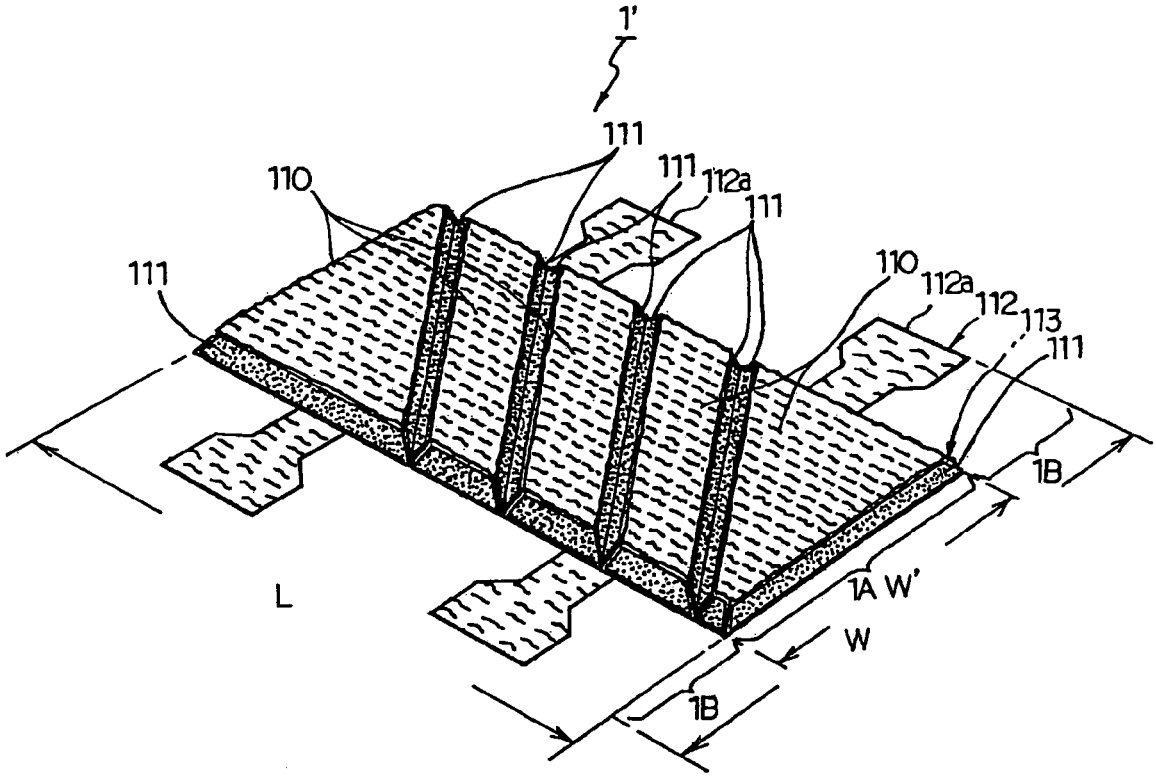
FIG. 25 is a perspective schematically illustrating still yet another embodiment of the cleaning sheet according to the present invention (corresponding to FIG. 16).

As in the cleaning sheet 1' of the embodiment shown in FIG. 25, the wiping portion may have the sloped or curved part (the sloped part in FIG. 25) along a position inward from the front and the rear edges of the head 20. According to this embodiment, relatively large dust particles once trapped onto the sloped part 111 are prevented from sticking out of the lower side 21 of the head and thereby prevented from pressing or rubbing an object to be cleaned, which can damage the object or allow the dust to come off the trap.

The fixing portions of the cleaning sheet according to the present invention are not limited to the configurations in the foregoing embodiments and can be altered in accordance with the design of the head of a cleaning tool.

For example, while in the foregoing embodiments the fixing portions 1B are formed of the base sheet 112 per se, tackiness may be imparted to the surface of the base sheet so that the base sheet may be removably attached to the head of a cleaning tool.

In another embodiment, the base sheet 112 is shaped to provide a plurality of tags 112*a* sticking out of the front and the rear edges to serve as fixing portions 1B as in the cleaning sheet 1' illustrated in FIG. 26 (in the particular case of FIG. 26, two tags 112*a* for each of the front and the rear edges). The tags 112*a* are attached to the head to fix the cleaning sheet 1'. According to this embodiment, the base sheet 112 can be reduced in area to cut down the material cost.

Thus, the fixing portions are not restricted in shape and material as long as they allow for attaching and fixing the cleaning sheet to the head of a cleaning tool. In still another embodiment, the base sheet may be connected to another member serving as a fixing portion near each of the front and the rear edges or each of the left and the right edges of the wiping portion. More specifically, a plurality of strings may be connected to the base sheet near the front and the rear edges to stick out and serve as fixing portions, and the strings are tied on the head to fix the cleaning sheet to the head. Otherwise, a plurality of elastic members, such as rubber strings, are provided to connect the front and the rear edges or the left and the right edges of the base sheet. The elastic members are put over the head to attach the cleaning sheet to the head.

INDUSTRIAL APPLICABILITY

The present invention provides a cleaning sheet that traps relatively large solid dust particles as well as fine dust without fail in a usual sweeping operation on an object to be cleaned.

The invention claimed is:

1. A cleaning sheet adapted to be attached to a head of a cleaning tool and having a wiping portion adapted to be disposed on a lower side of the head, the wiping portion, in the state attached to the head, having a plurality of tacky recesses, at least a portion of each of which is coated with a pressure sensitive adhesive, open to at least one direction selected from the directions to the front, the rear, the left, and the right of the head and having a tapered or curved shape projecting in the at least one direction between borders of adjacent two of the recesses, the borders being along the at least one direction, wherein the portion of each tacky recess coated with adhesive includes first and second adjacent surfaces of the tacky recess, the first adjacent surface disposed at an angle relative to the second adjacent surface and the first and second adjacent surfaces are each disposed at oblique angles relative to the lower side of the head.

2. The cleaning sheet according to claim 1, wherein the cleaning sheet includes a base sheet and a wiping sheet fixedly adhered to a surface of a middle region of the base sheet, the wiping sheet including cutouts at front and rear edges and corresponding in shape to the recesses such that the wiping sheet includes a strip extending across a width of the middle region, and a row of triangles projecting from the strip in the front and rear directions.

3. A cleaning sheet adapted to be attached to the head of a cleaning tool and having a wiping portion adapted to be disposed on the lower side of the head, the wiping portion, in the state attached to the head, having a plurality of tacky recesses open to at least one direction selected from the directions to the front, the rear, the left, and the right of the head and having a pointed or curved shape projecting in the at least one direction between borders of adjacent two of the recesses, the borders being along the at least one direction, wherein the recesses open to opposite directions and are interconnected to each other in a configuration such that the interconnected recesses are impenetrable from the opposite directions.

4. A cleaning sheet adapted to be attached to a head of a cleaning tool and having a wiping portion adapted to be disposed on a lower side of the head, the wiping portion, in the state attached to the head, having a plurality of tacky recesses, at least a portion of each of which is coated with a pressure sensitive adhesive, open to at least one direction selected from the directions to the front, the rear, the left, and the right of the head and having a pointed or curved shape projecting in the at least one direction between borders of adjacent two of the recesses, the borders being along the at least one direction, wherein at least two of the recesses meet each other at a point on an edge of the head.

5. The cleaning sheet according to claim 4, comprising a base sheet and a wiping sheet on the surface of the base sheet, the wiping sheet being shaped to form the recesses.

6. The cleaning sheet according to claim 5, which is double-sided reversible with the wiping sheet on both sides of the base sheet.

7. A cleaning sheet adapted to be attached to the head of a cleaning tool and having a wiping portion adapted to be disposed on the lower side of the head, the wiping portion, in the state attached to the head, having a tacky recess, at least a portion of which is coated with a pressure sensitive adhesive, extending in the length direction of the head with a prescribed width, wherein the portion of each tacky recess coated with adhesive includes first and second adjacent surfaces of the tacky recess, the first adjacent surface disposed at an angle relative to the second adjacent surface and the first and second adjacent surfaces are each disposed at oblique angles relative to the lower side of the head.

8. A cleaning sheet adapted to be attached to the head of a cleaning tool and having a wiping portion adapted to be disposed on the lower side of the head, the wiping portion, in the state attached to the head, having a flat part and a tacky sloped or curved part, at least a portion of which is coated with a pressure sensitive adhesive, rising from the flat part, the flat part and the sloped or curved part being substantially along the lower side of the head, wherein the portion of each tacky recess coated with adhesive includes first and second adjacent surfaces of the tacky recess, the first adjacent surface disposed at an angle relative to the second adjacent surface and the first and second adjacent surfaces are each disposed at obliquely angles relative to the lower side of the head.

9. The cleaning sheet according to claim 8, wherein the sloped or curved part is along at least one of the front, the rear, the left, and the right edges of the wiping portion.

10. The cleaning sheet according to claim 9, which comprises a base sheet and a bulky member fixed on the base sheet, the bulky member having faces corresponding to the flat part and the sloped or curved part.

11. The cleaning sheet according to claim 9, which comprises a single sheet having a thick and bulky wiping portion and a thin fixing portion.

12. The cleaning sheet according to claim 8, which comprises a base sheet and a bulky member fixed on the base sheet, the bulky member having faces corresponding to the flat part and the sloped or curved part.

13. The cleaning sheet according to claim 8, which comprises a single sheet having a thick and bulky wiping portion and a thin fixing portion.

14. The cleaning sheet according to claim 8, which is double-sided reversible.

15. A cleaning sheet adapted to be attached to a head of a cleaning tool and having a wiping portion adapted to be disposed on a lower side of the head, the wiping portion, in the state attached to the head, having a plurality of tacky recesses, at least a portion of each of which is coated with a pressure sensitive adhesive, open to at least one direction selected from the directions to the front, the rear, the left, and the right of the head and having pointed shapes projecting in the at least one direction between borders of adjacent two of the recesses, the borders being along the at least one direction, wherein the pointed shapes are disposed between the tacky recesses and extend beyond a leading edge of the head of the cleaning tool.

16. A cleaning sheet adapted to be attached to a head of a cleaning tool and having a wiping portion adapted to be disposed on a lower side of the head, the wiping portion, in the state attached to the head, having a plurality of tacky recesses, at least a portion of each of which is coated with a pressure sensitive adhesive, open to at least one direction selected from the directions to the front, the rear, the left, and the right of the head and having a pointed or curved shape projecting in the at least one direction between borders of adjacent two of the recesses, the borders being along the at least one direction, wherein the recesses each include a mouth proximate a leading edge of the head, and said mouth is wider than an intermediate section of the recess, and said intermediate section of the recess is narrower than an interior section of the recess, which interior section of the recess is farther from the leading edge than is the intermediate section.

17. A cleaning sheet adapted to be attached to a head of a cleaning tool and having a wiping portion adapted to be disposed on a lower side of the head, the wiping portion, in the state attached to the head, having a plurality of tacky recesses, at least a portion of each of which is coated with a pressure sensitive adhesive, open to at least one direction selected from the directions to the front, the rear, the left, and the right of the head and having a pointed or curved shape projecting in the at least one direction between borders of adjacent two of the recesses, the borders being along the at least one direction, wherein, in a state where the cleaning sheet is attached to the head, some recesses open, like openings between teeth of a comb, toward a front direction and other recesses open, like openings between teeth of a comb, toward a rear direction.

* * * * *